US010034088B2

(12) United States Patent
Osako et al.

(10) Patent No.: US 10,034,088 B2
(45) Date of Patent: Jul. 24, 2018

(54) SOUND PROCESSING DEVICE AND SOUND PROCESSING METHOD

(71) Applicant: SONY CORPORATION, Tokyo (JP)

(72) Inventors: Keiichi Osako, Tokyo (JP); Kenichi Makino, Kanagawa (JP); Kohei Asada, Kanagawa (JP); Tetsunori Itabashi, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 15/522,628

(22) PCT Filed: Oct. 29, 2015

(86) PCT No.: PCT/JP2015/080481
§ 371 (c)(1),
(2) Date: Apr. 27, 2017

(87) PCT Pub. No.: WO2016/076123
PCT Pub. Date: May 19, 2016

(65) Prior Publication Data

US 2017/0332172 A1 Nov. 16, 2017

(30) Foreign Application Priority Data

Nov. 11, 2014 (JP) ..... 2014-228896

(51) Int. Cl.
*H04R 3/04* (2006.01)
*G10L 21/0232* (2013.01)
*H04R 29/00* (2006.01)

(52) U.S. Cl.
CPC ..... *H04R 3/04* (2013.01); *G10L 21/0232* (2013.01); *H04R 29/00* (2013.01); *H04R 2499/11* (2013.01)

(58) Field of Classification Search
None
See application file for complete search history.

(56) References Cited

U.S. PATENT DOCUMENTS 6,868,365 B2 * 3/2005 Balan ..... G06K 9/6245 702/177
8,666,090 B1 * 3/2014 Townsend ..... H04R 3/005 381/111

(Continued)

FOREIGN PATENT DOCUMENTS

CN 103166597 A 6/2013
JP 2001-100800 A 4/2001

(Continued)

OTHER PUBLICATIONS

Tatsuta, et al., "Blind Source Separation by the method of Orientation Histograms", IEICE Technical Report, Jun. 2005, 06 pages.

(Continued)

*Primary Examiner* — Paul Huber
(74) *Attorney, Agent, or Firm* — Chip Law Group

(57) ABSTRACT

The present technology relates to a sound processing device, a sound processing method, and a program, which can collect a desired sound. A sound processing device includes: a sound collection unit configured to collect a sound; an application unit configured to apply a predetermined filter to a signal of the sound collected by the sound collection unit; a selection unit configured to select a filter coefficient of the filter applied by the application unit; and a correction unit configured to correct the signal from the application unit. The selection unit selects the filter coefficient on the basis of the signal of the sound collected by the sound collection unit. The selection unit creates, on the basis of the signal of the sound collected by the sound collection unit, a histogram which associates a direction where the sound occurs and a strength of the sound and selects the filter coefficient on the basis of the histogram. The present technology can be applied to a sound processing device.

13 Claims, 27 Drawing Sheets

(56) References Cited

U.S. PATENT DOCUMENTS

| | | | | |
|---|---|---|---|---|
| 9,191,738 | B2 * | 11/2015 | Niwa | H04R 3/00 |
| 2003/0063759 | A1 * | 4/2003 | Brennan | H04R 3/005 381/92 |
| 2004/0013038 | A1 * | 1/2004 | Kajala | G01S 3/043 367/119 |
| 2010/0215184 | A1 * | 8/2010 | Buck | H04M 9/082 381/66 |
| 2013/0142359 | A1 | 6/2013 | Murata et al. | |
| 2016/0088392 | A1 * | 3/2016 | Huttunen | H04R 5/027 381/92 |

FOREIGN PATENT DOCUMENTS

| | | | |
|---|---|---|---|
| JP | 2010-091912 | A | 4/2010 |
| JP | 2013-120987 | A | 6/2013 |

OTHER PUBLICATIONS

Tatsuta, et al., "Blind Source Separation by the Method of Orientation Histograms", Technical Report of IEICE, The Institute of Electronics, Information and Communication Engineers Jun. 2005, pp. 1-6.

International Search Report and Written Opinion of PCT Application No. PCT/JP2015/080481, dated Feb. 2, 2016, 12 pages of English Translation and 10 pages of ISRWO.

International Preliminary Report on Patentability of PCT Application No. PCT/JP2015/080481, dated May 26, 2017, 12 pages of English Translation and 6 pages of IPRP.

* cited by examiner

SOUND PROCESSING DEVICE AND SOUND PROCESSING METHOD

CROSS REFERENCE TO RELATED APPLICATIONS

This application is a U.S. National Phase of International Patent Application No. PCT/JP2015/080481 filed on Oct. 29, 2015, which claims priority benefit of Japanese Patent Application No. JP 2014-228896 filed in the Japan Patent Office on Nov. 11, 2014. Each of the above-referenced applications is hereby incorporated herein by reference in its entirety.

TECHNICAL FIELD

The present technology relates to a sound processing device, a sound processing method, and a program. More specifically, the present technology relates to a sound processing device, a sound processing method, and a program, which can extract a desired sound as properly removing noise.

BACKGROUND ART

In recent years, a user interface that uses a sound has been getting popular. The user interface that uses a sound is used to make a phone call or search information, in a mobile phone (a device such as a smartphone) for example.

However, when the user interface is used in a condition with a lot of noise, a sound generated by a user cannot be properly analyzed due to the noise and a wrong process may be executed. Patent Document 1 proposes to emphasize a sound by a fixed beamformer, emphasize a noise by a block matrix unit, and perform generalized side lobe canceling. Further, Patent Document 1 proposes to switch a coefficient of the fixed beamformer by a beamformer switching unit and perform the switching by switching two filters between a case with a sound and a case without a sound.

CITATION LIST

Patent Document

Patent Document 1: Japanese Patent Application Laid-Open No. 2010-91912

SUMMARY OF THE INVENTION

Problems to be Solved by the Invention

When filters having different characteristics are switched between a case with a sound and a case without a sound as described in Patent Document 1, it is difficult to switch to a proper filter if a proper sound zone cannot be detected. However, it is difficult to detect a proper sound zone and this may cause a correct sound zone not to be properly detected and the filter not to be switched to a proper filter.

Further, according to Patent Document 1, since the filters are rapidly switched between a case with a sound and a case without a sound, sound quality may suddenly change and user may have a discomfort feeling.

Further, it may be considered that an effect to the sound quality is not large if the existing noise is generated at a point sound source; however, a noise is widespread in general. In addition, a sudden noise may occur. It is preferable to obtain a desired sound by handling such various noises.

The present technology is made in view of the above problem so that the filter can be properly switched and a desired sound can be obtained.

Solutions to Problems

A sound processing device of an aspect of the present technology includes: a sound collection unit configured to collect a sound; an application unit configured to apply a predetermined filter to a signal of the sound collected by the sound collection unit; a selection unit configured to select a filter coefficient of the filter applied by the application unit; and a correction unit configured to correct the signal from the application unit.

The selection unit may select the filter coefficient on the basis of the signal of the sound collected by the sound collection unit.

The selection unit may create, on the basis of the signal of the sound collected by the sound collection unit, a histogram which associates a direction where the sound occurs and a strength of the sound and may select the filter coefficient on the basis of the histogram.

The selection unit may create the histogram on the basis of signals accumulated for a predetermined period of time.

The selection unit may select a filter coefficient of a filter that suppresses the sound in an area other than an area including a largest value in the histogram.

A conversion unit configured to convert the signal of the sound collected by the sound collection unit into a signal of a frequency range may further be included, wherein the selection unit may select the filter coefficient for all frequency bands by using the signal from the conversion unit.

A conversion unit configured to convert the signal of the sound collected by the sound collection unit into a signal of a frequency range may further be included, wherein the selection unit may select the filter coefficient for each frequency band by using the signal from the conversion unit.

The application unit may include a first application unit and a second application unit, the sound processing device may further include a mixing unit configured to mix signals from the first application unit and the second application unit, when a first filter coefficient is switched to a second filter coefficient, a filter with the first filter coefficient may be applied in the first application unit and a filter with the second filter coefficient may be applied in the second application unit, and the mixing unit may mix the signal from the first application unit and a signal from the second application unit with a predetermined mixing ratio.

After a predetermined period of time has passed, the first application unit may start a process in which the filter with the second filter coefficient is applied and the second application unit stops processing.

The selection unit may select the filter coefficient on the basis of an instruction from a user.

The correction unit may perform a correction to further suppress a signal which has been suppressed in the application unit when the signal of the sound collected by the sound collection unit is smaller than the signal to which a predetermined filter is applied by the application unit, and may perform a correction to suppress a signal which has been amplified by the application unit when the signal of the sound collected by the sound collection unit is larger than the signal to which a predetermined filter is applied by the application unit.

The application unit may suppress a constant noise, and the correction unit may suppress a sudden noise.

A sound processing method of an aspect of the present technology includes: collecting a sound; applying a predetermined filter to a signal of the collected sound; selecting a filter coefficient of the applied filter; and correcting the signal to which the predetermined filter is applied.

A program of an aspect of the present technology causes a computer to execute a process including the steps of: collecting a sound; applying a predetermined filter to a signal of the collected sound; selecting a filter coefficient of the applied filter; and correcting the signal to which the predetermined filter is applied.

According to an aspect of the sound processing device, sound processing method, and program according to the present technology, a noise can be suppressed and a desired sound can be collected by collecting a sound, applying a predetermined filter to a signal of the collected sound, selecting a filter coefficient of the applied filter, and correcting the signal to which the predetermined filter is applied.

Effects of the Invention

According to an aspect of the present technology, filters can be properly switched and a desired sound can be obtained.

Here, the effects described here do not set any limitation and anyone of the effects described in this specification may be realized.

MODE FOR CARRYING OUT THE INVENTION

In the following, a mode (hereinafter, referred to as "an embodiment") for carrying out the present technology will be described. It is noted that the descriptions will be given in the following order.

1. External configuration of sound processing device
2. About sound source
3. Internal configuration and operation of first sound processing device (first-1 and first-2 sound processing devices)
4. Internal configuration and operation of second sound processing device (second-1 and second-2 sound processing devices)
5. About recording medium <External Configuration of Sound Processing Device>

Figure 1:
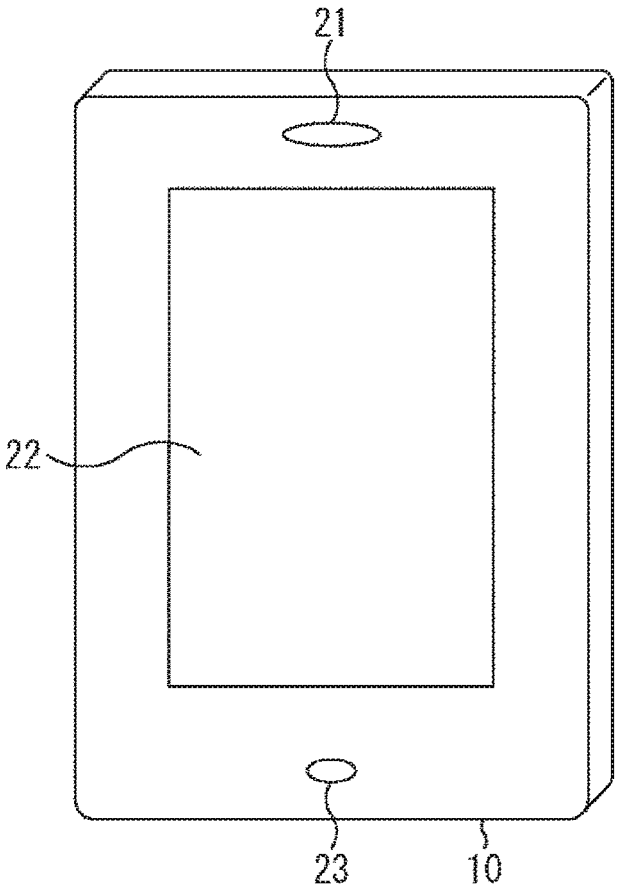
FIG. 1 is a diagram illustrating an embodiment of a sound processing device according to the present technology.

FIG. 1 is a diagram illustrating an external configuration of a sound processing device according to the present technology. The present technology can be applied to a device that processes a sound signal. For example, the present technology can be applied to a mobile phone (including a device called a smartphone or the like), a part for processing a signal from a microphone in a game machine, noise-canceling headphones or earphones, or the like. Further, the present technology can be applied to a device having an application that realizes a hands-free phone call, a voice interactive system, a voice command input, a voice chat, and the like.

Further, the sound processing device according to the present technology may be a mobile terminal or a device used as being placed at a predetermined location. Further, the present technology may be applied to a device called a wearable device, which is a glasses-type terminal or a terminal wearable on an arm or the like.

Here, the explanation will be given using a mobile phone (smartphone) as an example. FIG. 1 is a diagram illustrating an external configuration of a mobile phone 10. On one surface of the mobile phone 10, there are a speaker 21, a display 22, and a microphone 23.

The speaker 21 and the microphone 23 are used for a voice phone call. The display 22 displays various information. The display 22 may be a touch panel.

The microphone 23 has a function to collect a voice of a user and is a part to which a target sound processed in a later described process is input. The microphone 23 is an electret condenser microphone, an MEMS microphone, or the like. Further, sampling is performed by the microphone 23 with 16000 Hz for example.

Figure 3:
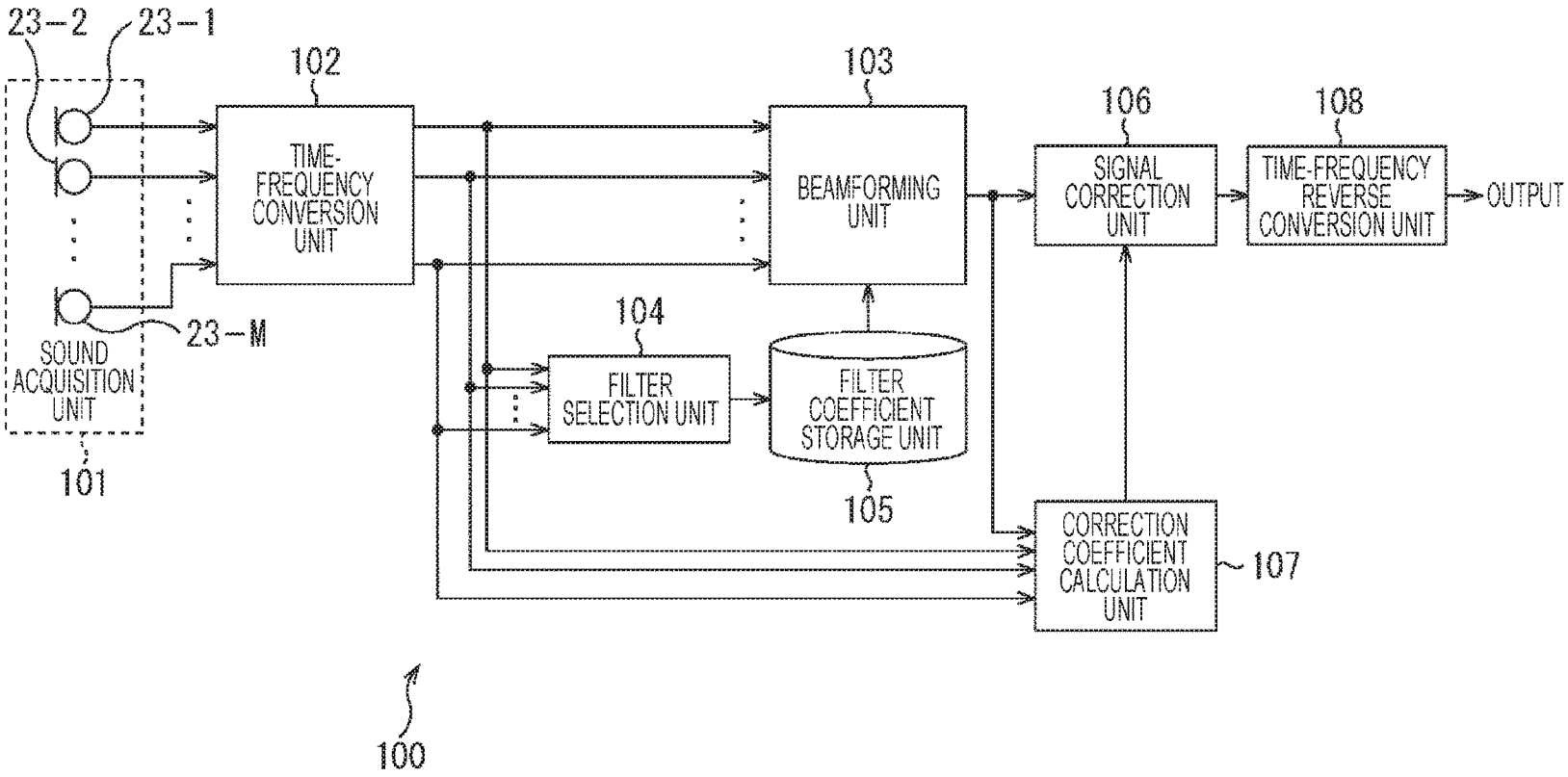
FIG. 3 is a diagram illustrating an internal configuration of a first-1 sound processing device.

Further, in FIG. 1, only one microphone 23 is illustrated but two or more microphones 23 are provided as described later. In FIG. 3 and subsequent drawings, more than one microphone 23 is illustrated as a sound collection unit. The sound collection unit includes two or more microphones 23.

The illustrated installed position of the microphone 23 in the mobile phone 10 is an example and the installed position is not limited to the lower center portion illustrated in FIG. 1. For example, although it is not illustrated, each microphone 23 may be provided at lower right and lower left of the mobile phone 10, or two or more microphones 23 may be provided on a surface different from the display 22 such as on a side face of the mobile phone 10 for example.

It may be different, depending on the device that includes the microphones 23, where the microphones 23 are placed or how many microphones 23 are provided as long as the microphones 23 are provided at a proper installation position of each device.

<About Sound Source>

Figure 2A:
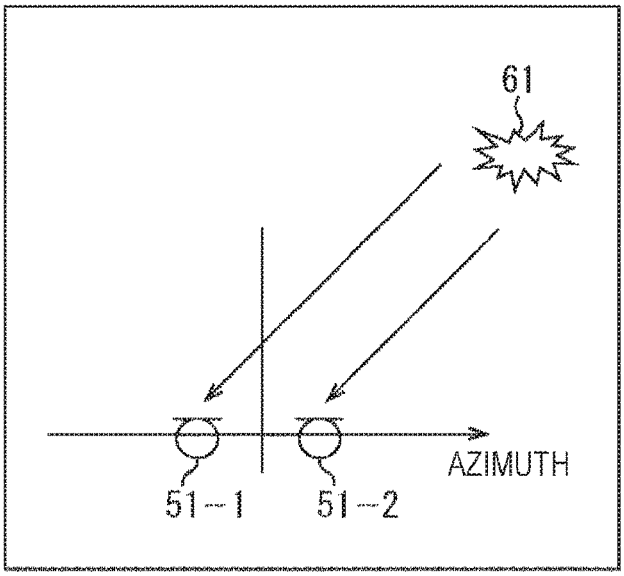
FIGS. 2A and 2B are diagrams for explaining sound sources.
Figure 2B:
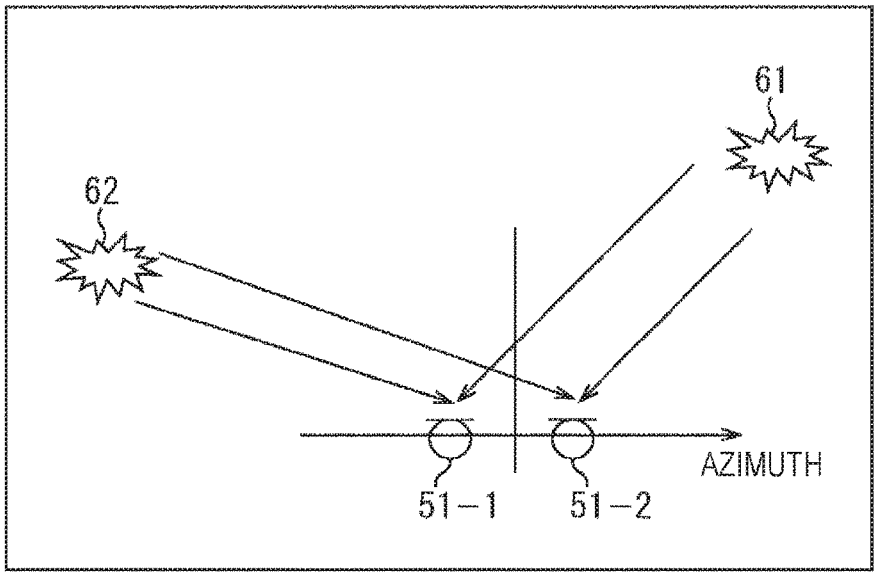

With reference to FIGS. 2A and 2B, terms of "sound source" and "noise," which are used in the following explanation, will be explained. FIG. 2A is a diagram for explaining a constant noise. A microphone 51-1 and a microphone 51-2 are provided at a substantially center part. Hereinafter, when it is not particularly needed to distinguish the microphone 51-1 and microphone 51-2 individually, they are simply referred to as a microphone 51. Other parts are also described in a similar manner.

Out of the sounds collected by the microphone 51, a sound that causes a noise which is not desirable to collect is assumed to be generated by a sound source 61. The noise generated by the sound source 61 is, for example, a noise that is constantly generated from a same direction, such as a fan noise of a projector and a noise of an air conditioner. Such a noise is defined here as a constant noise.

FIG. 2B is a diagram for explaining a sudden noise. The condition illustrated in FIG. 2B is that a constant noise is generated by the sound source 61 and a sudden noise is generated by a sound source 62. The sudden noise is a noise that is suddenly generated in a direction different from that of the constant noise and lasts for a relatively short time, such as a sound generated when a pen falls and person's coughing or sneezing, for example.

When there is a constant noise and a sudden noise is generated while executing a process to remove the constant noise and extract a desired sound, the sudden noise cannot be handled and, in other words, the sudden noise cannot be removed and this may affect the extraction of the desired sound. Or, for example, in a case that a sudden noise is generated, a filter for processing the sudden noise is used, and then the filter for processing the constant noise is used again while processing a constant noise by applying a predetermined filter, the filter switching is frequently repeated and a noise may be caused by the filter switching.

In view of the above, a sound processing device that reduces a constant noise, properly handles a generated sudden noise, and processes not to cause a new noise by the process to reduce the noise will be described.

<Internal Configuration and Operation of First Sound Processing Device>

<Internal Configuration and Operation of First-1 Sound Processing Device>

FIG. 3 is a diagram illustrating a configuration of a first-1 sound processing device 100. The sound processing device 100 is provided in the mobile phone 10 and composes apart of the mobile phone 10. The sound processing device 100 illustrated in FIG. 3 includes a sound collection unit 101, a time-frequency conversion unit 102, a beam forming unit 103, a filter selection unit 104, a filter coefficient storage unit 105, a signal correction unit 106, a correction coefficient calculation unit 107, and a time-frequency reverse conversion unit 108.

Here, the mobile phone 10 also includes a communication unit to function as a telephone and a function to connect to a network; however, a configuration of the sound processing device 100 related to sound processing is illustrated, and illustration and explanation of other functions are omitted here.

The sound collection unit 101 includes the plurality of microphones 23 and, in the example illustrated in FIG. 3, M number of microphones 23-1 to 23-M are provided.

A sound signal collected by the sound collection unit 101 is provided to the time-frequency conversion unit 102. The time-frequency conversion unit 102 converts the provided signal of a time range into a signal of a frequency range and provides the signal to each of the beamforming unit 103, filter selection unit 104, and correction coefficient calculation unit 107.

The beamforming unit 103 performs a process of beamforming by using the sound signals of the microphones 23-1 to 23-M, which are provided from the time-frequency conversion unit 102, and a filter coefficient provided from the filter coefficient storage unit 105. The beamforming unit 103 has a function for performing a process with a filter and beamforming is one of the examples of the function. The beamforming executed by the beamforming unit 103 is a process of beamforming of an addition-type or a subtraction-type.

The filter selection unit 104 calculates an index of a filter coefficient used in beamforming by the beamforming unit 103, for each frame.

The filter coefficient storage unit 105 stores the filter coefficient used in the beamforming unit 103.

The sound signal output from the beamforming unit 103 is provided to the signal correction unit 106 and correction coefficient calculation unit 107.

The correction coefficient calculation unit 107 receives the sound signal from the time-frequency conversion unit 102 and a beamformed signal from the beamforming unit 103, and calculates a correction coefficient used in the signal correction unit 106, on the basis of the signals.

The signal correction unit 106 corrects the signal output from the beamforming unit 103 by using the correction coefficient calculated by the correction coefficient calculation unit 107.

The signal corrected by the signal correction unit 106 is provided to the time-frequency reverse conversion unit 108. The time-frequency reverse conversion unit 108 converts the provided signal of a frequency band into a signal of a time range and outputs the signal to an unillustrated unit in a later stage.

With reference to the flowcharts of FIGS. 4 and 5, an operation of the first-1 sound processing device 100 illustrated in FIG. 3 will be described.

In step S101, sound signals are respectively collected by the microphones 23-1 to 23-M of the sound collection unit 101. Here, the collected sound in this example is a sound generated by a user, a noise, and a sound of mixture of those.

In step S102, input signals are clipped for each frame. The sampling in a case of clipping is performed with 16000 Hz for example. In this example, a signal of a frame clipped from the microphone 23-1 is set as a signal $x_1$ (n), . . . a signal of a frame clipped from the microphone 23-2 is set as a signal $x_2$(n), . . . and a signal of a frame clipped from the microphone 23-M is set as a signal $x_m(n)$. Here, m represents an index (1 to M) of the microphones, and n represents a sample number of a signal in which a sound is included.

The clipped signals $x_1(n)$ to $x_m(n)$ are each provided to the time-frequency conversion unit 102.

In step S103, the time-frequency conversion unit 102 converts the provided signals x1(*n*) to xm(n) into respective time-frequency signals. With reference to FIG. 6A, to the time-frequency conversion unit 102, time range signals x1(*n*) to xm(n) are input. The signals x1(*n*) to xm(n) are each separately converted into frequency range signals.

In this example, the description will be given under an assumption that the time range signal $x_1(n)$ is converted into a frequency range signal $x_1(f,k)$, a time range signal $x_2(n)$ is converted into a frequency range signal $x_2(f,k)$, . . . , and a time range signal $x_m(n)$ is converted into a frequency range signal $x_m(f,k)$. The letter f of (f,k) is an index indicating a frequency band, and the letter k of (f,k) is a frame index.

Figure 6B:
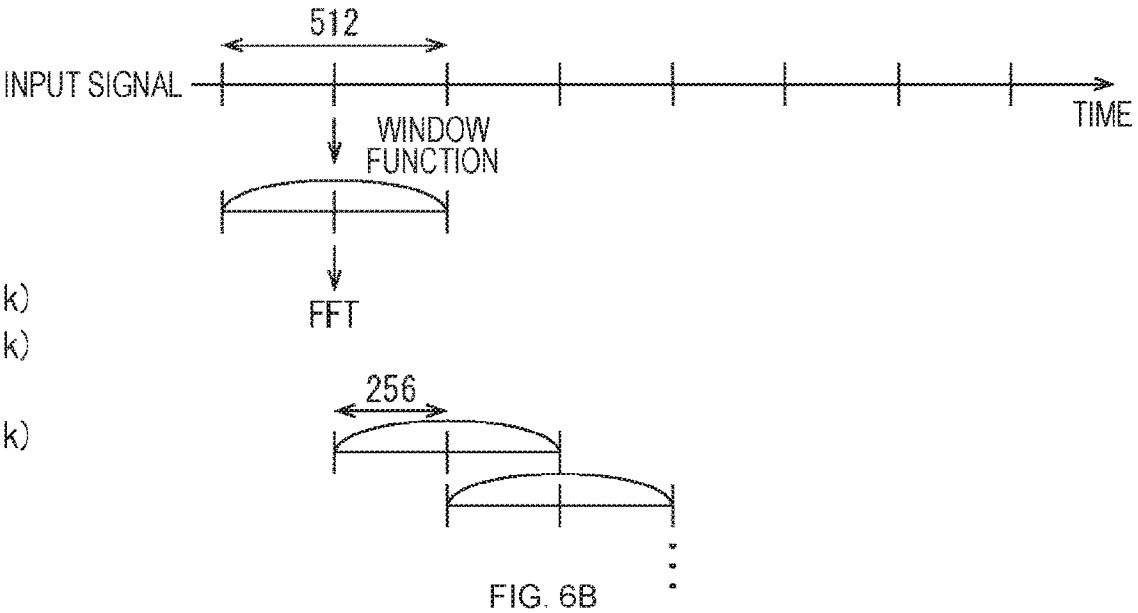
FIGS. 6A and 6B are diagrams for explaining a process by the time-frequency conversion unit.
Figure 6A:
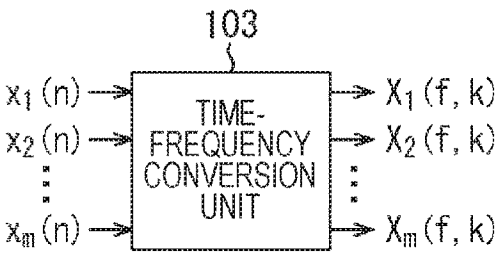

As illustrated in FIG. 6B, the time-frequency conversion unit 102 divides input time range signals x1(*n*) to xm(n) (hereinafter, the signal x1(*n*) is described as an example) into frames for every frame size N samples, applies a window function, and converts the signals into frequency range signals by using fast Fourier transform (FFT). In the frame division, a zone to extract an N/2 sample is shifted.

FIG. 6B illustrates an example that the frame size N is set to 512 and the shift size is set to 256. In other words, in this case, the input signal x1(*n*) is divided into frames having a frame size N of 512, a window function is applied, and the signal is converted into a frequency range signal by executing an FFT calculation.

Figure 4:
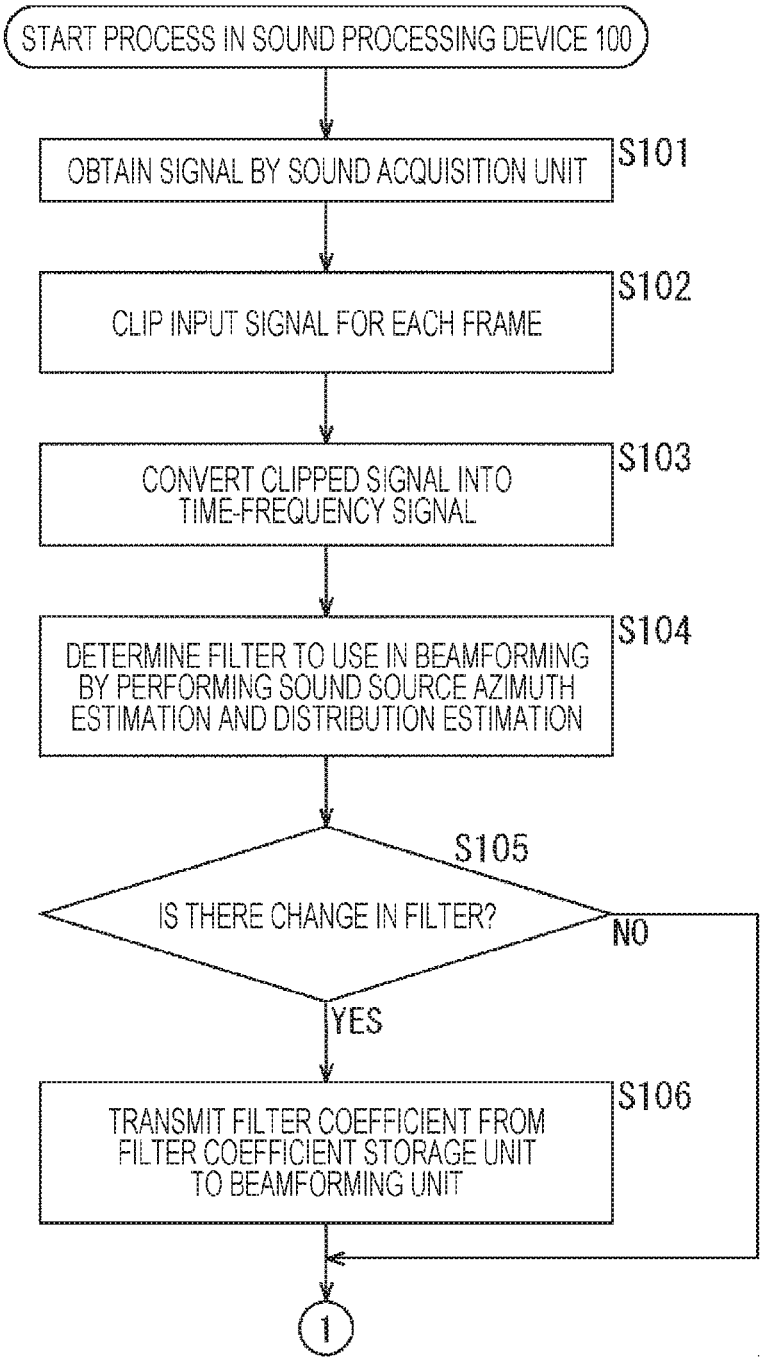
FIG. 4 is a flowchart for explaining an operation of the first-1 sound processing device.

Back to the explanation of the flowchart of FIG. 4, in step S103, the signals $x_1(f,k)$ to $x_m(f,k)$, which are converted into frequency range signals by the time-frequency conversion unit 102, are each provided to the beamforming unit 103, filter selection unit 104, and correction coefficient calculation unit 107.

In step S104, the filter selection unit 104 calculates an index I(k) of a filter coefficient used in beamforming for each frame. The calculated index I(k) is transmitted to the filter coefficient storage unit 105. A filter selection process is performed in the following three steps.

First Step: Sound Source Azimuth Estimation

Second Step: Creation of Sound Source Distribution Histogram

Third Step: Determination of Filter to be Used

First Step: Sound Source Azimuth Estimation

Firstly, the filter selection unit 104 performs a sound source azimuth estimation by using signals $x_1(f,k)$ to $x_m(f,k)$ which are time-frequency signals provided from the time-frequency conversion unit 102. The sound source azimuth estimation can be performed on the basis of a multiple signal classification (MUSIC) method for example. In the MUSIC method, a method described in the following document may be applied.

R. O. Schmidt, "Multiple emitter location and signal parameter estimation," IEEE Trans. Antennas Propagation, vol. AP-34, no. 3, pp. 276 to 280, March 1986.

The estimation result by the filter selection unit 104 is assumed as P(f,k). For example, in a case that microphones 23-1 to 23-M (FIG. 3) of the sound collection unit 101 are placed in a straight line, the estimation result P(f,k) becomes a scalar value from −90 degrees to +90 degrees. Here, the sound source azimuth may be estimated with a different estimation method.

Second Step: Creation of Sound Source Distribution Histogram

The result estimated in First step is accumulated. An accumulation time may be set to a period of previous ten seconds, for example. By using the estimation result of the amount of this accumulation time, a histogram is created. Here, by providing such an accumulation time, a sudden noise can be handled.

It will be obvious in the following description that, when a histogram is created on the basis of data of an accumulated amount of a predetermined time, even if a sudden noise occurs, the histogram is prevented from being significantly changed due to data of the sudden noise.

When the histogram does not change by a certain amount, the filter is not switched in a later process and this can prevent the filter from being switched due to an effect of a sudden noise. Thus, the filter can be prevented from being frequently switched due to an effect of a sudden noise, and stability is improved.

Figure 7:
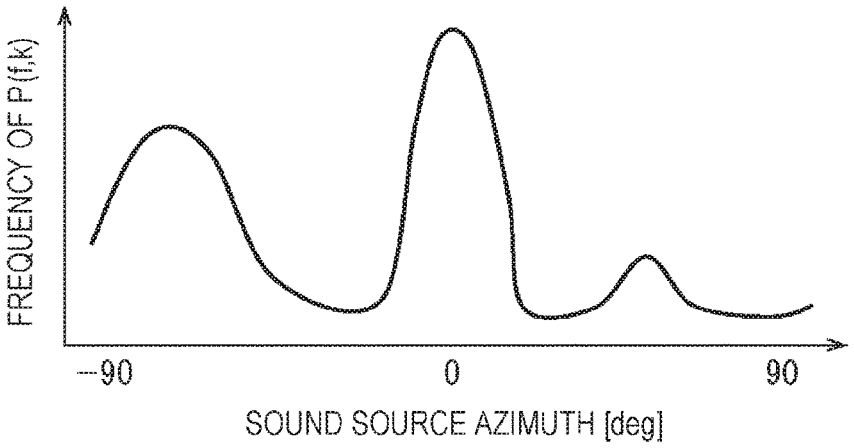
FIG. 7 is a diagram illustrating an example of a created histogram.

FIG. 7 illustrates an example of a histogram created on the basis of the data accumulated for the predetermined time (sound source estimation result). In the histogram illustrated in FIG. 7, the horizontal axis represents sound source azimuths, which are scalar values from −90 degrees to +90 degrees as described above. The vertical axis represents frequency of the sound source azimuth estimation results P(f,k).

Referring to the histogram, a condition of distribution of a sound source such as a target sound and a noise existing in the space can be clearly seen. For example, on the basis of the histogram illustrated in FIG. 7, since a value where the sound source azimuth is 0 degrees is greater than the values of other azimuths, it can be read that a target sound source is at 0 degrees, which is in the front direction. Further, since there is a high value at azimuth of −70 degrees or so, it can be read that a noise such as a constant noise occurs in that direction.

Such a histogram may be created for each frequency or may be created for all frequencies. The following description will be given with an example that the histogram is created as integrating all frequencies.

Third Step: Determination of Filter to be Used

When a histogram is created, a filter to be used is determined in Third step. In this example, the description will be given under an assumption that the filter coefficient storage unit 105 maintains filters of three patterns illustrated in FIG. 8 and the filter selection unit 104 selects one of the filters of the three patterns.

Figure 8:
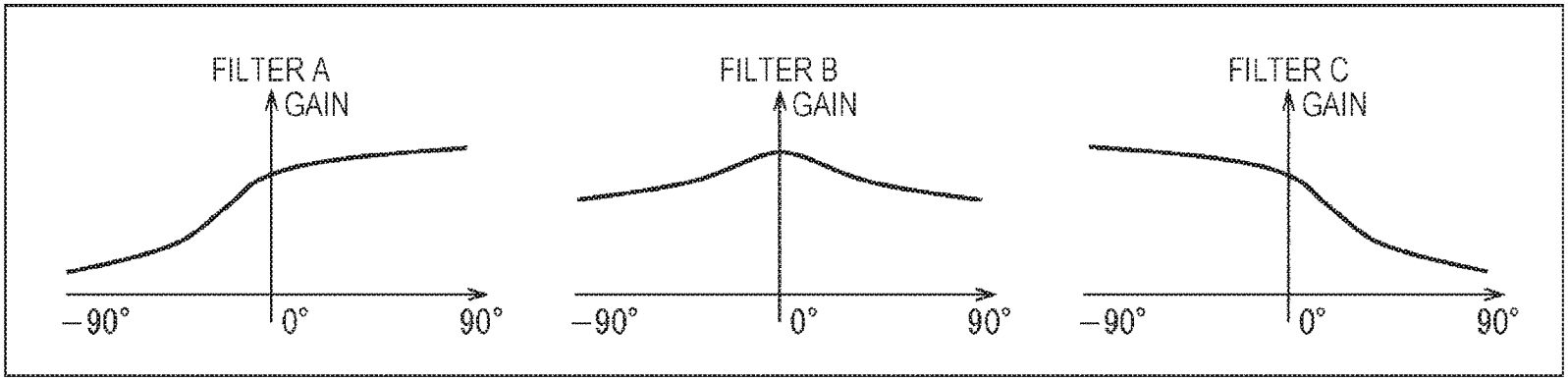
FIG. 8 is a diagram illustrating an example of a filter.

FIG. 8 illustrates patterns of a filter A, a filter B, and a filter C. In FIG. 8, the horizontal axis represents angles from −90 degrees to 90 degrees, and the vertical axis represents gain. The filters A to C selectively extract sounds coming from predetermined angles and, in other words, the filters A to C are filters to reduce sound coming from angles other than the predetermined angles.

The filter A is a filter that significantly reduces gain in the left side (−90 degree azimuth) seen from the sound processing device. The filter A is selected, for example, when it is desired to obtain a sound in the right side (+90 degrees azimuth) seen from the sound processing device or when it is determined that there is a nose in the left side and it is desired to reduce the noise.

The filter B is a filter that enlarges gain at a center (0-degree azimuth) seen from the sound processing device and reduces gain in other directions compared to the center area. The filter B is selected, for example, when it is desired to obtain a sound at the center area (0-degree azimuth) seen from the sound processing device, when it is determined that there are noises in both right side and left side and it is desired to reduce the noises, or when noises occur in a wide area and neither filter A nor filter C (later described) can be applied.

The filter C is a filter that significantly reduces gain in the right side (90-degree azimuth) seen from the sound processing device. The filter C is selected, for example, when it is desired to obtain a sound in the left side (−90-degree azimuth) seen from the sound processing device, or when it is determined that there is a noise in the right side and it is desired to reduce the noise.

Here, the description will be continued as an assumption that those filters are switched; however, it may be any configuration as long as each filter is a filter that extracts a sound to be collected and suppresses sounds other than the sound to be collected, and more than one filter like this is provided and switched.

Further, as filters (filter coefficients), a plurality of filters which are set corresponding to a plurality of environmental noises are set in advance, each of the plurality of filters has a fixed coefficient, and one or more filters corresponding to an environmental noise are selected from the plurality of filters of the fixed coefficients.

Figure 9:
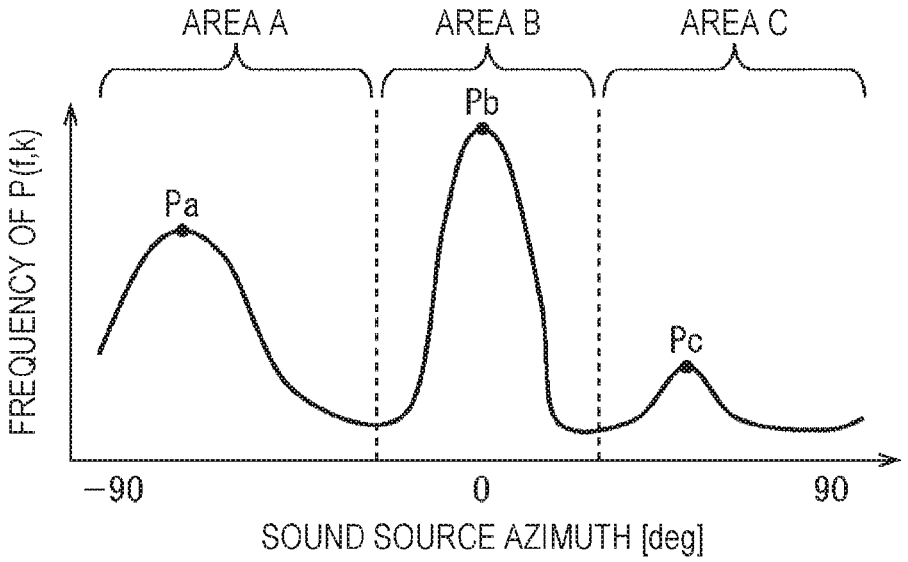
FIG. 9 is a diagram illustrating an example of dividing a histogram.

Here, a description will be continued with an example that the above described three filters are provided. When such three filters are provided, the histogram generated in Second step will be divided into three areas. FIG. 9 is the histogram illustrated in FIG. 7 and is a diagram illustrating an example of dividing the histogram generated in Second step into three areas.

In the example illustrated in FIG. 9, the histogram is divided into three areas of the area A, area B, and area C. The area A is an area from −90 degrees to −30 degrees, the area B is an area from −30 degrees to 30 degrees, and the area C is an area from 30 degrees to 90 degrees.

Highest signal strengths in the three areas are compared. The highest signal strength in the area A is strength Pa, the highest signal strength in the area B is strength Pb, and the highest signal strength in the area C is strength Pc.

The relationship among the strengths is described as follows.

$$\text{strength } Pb > \text{strength } Pa > \text{strength } Pc$$

In a case of such a relationship, it is determined that the strength Pb is the sound from the desired sound source. In other words, in this case, the sound having the strength Pb in the area B is the sound which is desired to be obtained compared to the sounds in other areas.

In this manner, when the strength Pb is a sound desired to be obtained, it is likely that the respective sounds of the remaining strength Pa and strength Pc are noises. When the remaining area A and area C are compared, between the strength Pa in the area A and the strength Pb in the area B, the strength Pa is greater than the strength Pc. In this case, it may be preferable to suppress the noise in the area A, which is a noise and has a great strength.

In other words, in this case, the filter A is selected. With the filter A, the sound in the area A is suppressed and the sounds in the area B and area C are output without being suppressed.

In this manner, a filter is selected by generating a histogram, dividing the histogram into areas corresponding to the number of the filters, and comparing the signal strengths in the divided areas. As described above, since the histogram is generated as accumulating the data in the past, even when itself that a rapid change such as a sudden noise is involved occurs, the histogram can be prevented from being significantly changed due to data of the rapid change.

Thus, in the selection of the filter A, filter B, and filter C, switching to another filter drastically or switching filters frequently can be prevented, so that a stable filter ring is compensated.

Here, in this example, the above description has been given with an example that the number of filters is three; however, it is obvious that the number may be any number other than three. Further, the description has been given that the number of filters and the dividing number of the histogram are the same number; however the numbers may be different numbers.

Further, for example, the filter A and filter C illustrated in FIG. 8 may be maintained and the filter B may be created in combination of the filter A and filter C. Further, a plurality of filters may be selected such that the filter A and filter C are applied.

Further, more than one filter group including a plurality of filters may be maintained and a filter group may be selected.

Further, in the above described example, the filter is determined on the basis of the histogram; however, an application range of the present technology is not limited to this method. For example, there may be a method, in which a relationship between a shape of the histogram and a most preferable filter may be learned by using a machine learning algorism in advance and a filter to be selected is determined.

Figure 10A:
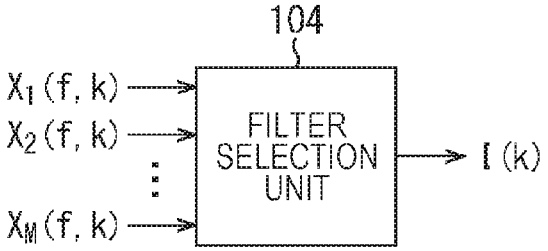
FIGS. 10A and 10B is a are diagrams illustrating a configuration of a filter selection unit.

In this example, as illustrated in FIG. 10A, it has been explained that the signals x1(*f,k*) to xm(f,k) which are converted into frequency range signals by the time-frequency conversion unit 102 are input to the filter selection unit 104 and one filter index I(k) is output for every frame.

Figure 10B:
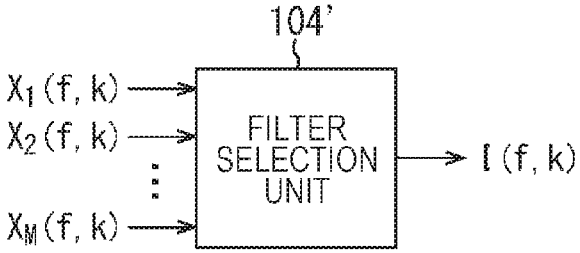

As illustrated in FIG. 10B, the signals x1(*f,k*) to xm(f,k) which are converted into frequency range signals by the time-frequency conversion unit 102 are input to the filter selection unit 104 and a filter index I(f,k) may be obtained for every frequency band. In this manner, when a filter index is obtained for each frequency band, a more delicate control can be performed.

The following explanation will be continued under an assumption that a filter index is output to the filter coefficient storage unit 105 for each frame as illustrated in FIG. 10A. Further, the explanation will be continued with an example that the filters are the filters A to C illustrated in FIG. 8.

The explanation will be given referring back to the flowchart of FIG. 4. In step S104, when the filter selection unit 104 decides a filter to be used in beamforming as described above, the process proceeds to step S105.

In step S105, it is determined whether the filter is changed. For example, in step S104, the filter selection unit 104 sets a filter, stores the set filter index, compares the set filter index with a filter index stored at a previous timing, and determines whether or not the indexes are the same. By executing this process, the process in step S105 is performed.

When it is determined in step S105 that the filter is not changed, the process in step S106 is skipped and the process proceeds to step S107 (FIG. 5), and when it is determined that the filter is changed, the process proceeds to step S106.

In step S106, the filter coefficient is read from the filter coefficient storage unit 105 and supplied to the beamforming unit 103. The beamforming unit 103 performs beamforming in step S107. Here, the explanation will be given about the beamforming performed in the beamforming unit 103 and a filter index which is used in the beamforming and is read from the filter coefficient storage unit 105.

With reference to FIGS. 11A, 11B and 11C and 12A and 12B, a process performed in the beamforming 103 will be described. Beamforming is a process to collect sound by using a plurality of microphones (microphone array) and add or subtract the sound by adjusting phase input to each of the microphones. By the beamforming, a sound in a particular direction can be enhanced or attenuated.

A sound enhancement process may be executed by addition-type beamforming. Delay and Sum beamforming (hereinafter, referred to as DS) is addition-type beamforming and enhances gain of a target sound azimuth.

A sound attenuation process may be executed by attenuation-type beamforming. Null beam forming (hereinafter, referred to as NBF) is attenuation-type beamforming and attenuates gain of a target sound azimuth.

Figure 11C:
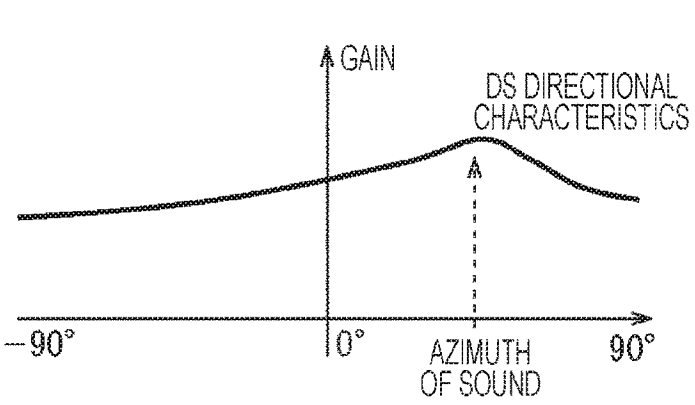
FIGS. 11A and 11B is a are diagrams for explaining beamforming.

Firstly, with reference to FIGS. 11A, 11B and 11C, a description will be given with an example that DS beamforming, which is addition-type beamforming, is used. As illustrated in FIG. 11A, the beamforming unit 103 inputs signals x1(*f,k*) to xm(f,k) from the time-frequency conversion unit 102 and inputs a filter coefficient vector C(f,k) from the filter coefficient storage unit 105. Then, as a result of the process, a signal D(f,k) is output to the signal correction unit 106 and correction coefficient calculation unit 107.

Figure 11B:
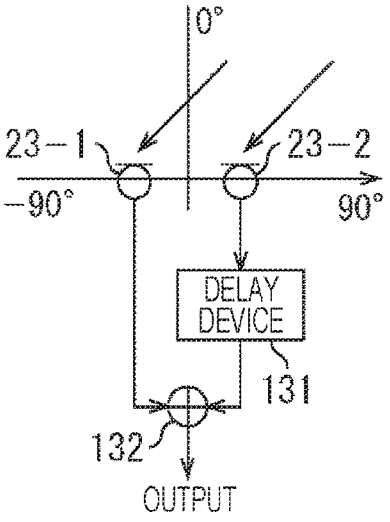
Figure 11A:
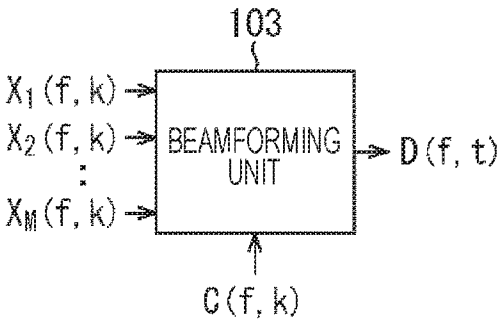

When a sound enhancement process is performed on the basis of DS beamforming, the beamforming unit 103 has a configuration illustrated in FIG. 11B. The beamforming unit 103 is configured to include a delay device 131 and an adder 132. In FIG. 11B, the time-frequency conversion unit 102 is not illustrated. Further, FIG. 11B illustrates an example that two microphones 23 are used.

The sound signal from the microphone 23-1 is provided to the adder 132, and the sound signal from the microphone 23-2 is delayed by a predetermined time by the delay device 131 and provided to the adder 132. The microphone 23-1 and microphone 23-2 are provided apart with a predetermined distance and receive signals with propagation delay times which are different by an amount of a channel difference.

In beamforming, a signal from one of the microphones 23 is delayed so as to compensate a propagation delay related to a signal which comes from a predetermined direction. The delay is performed by the delay device 131. In the DS beamforming illustrated in FIG. 11B, the delay device 131 is provided in the side of the microphone 23-2.

In FIG. 11B, it is assumed that the side of the microphone 23-1 is −90 degrees, the side of the microphone 23-2 is 90 degrees, and a front side of the microphone 23, where is in vertical direction with respect to an axis that passes through the microphone 23-1 and microphone 23-2 is 0 degrees. Further, in FIG. 11B, the arrows toward the microphones 23 represent sound waves of a sound coming from a predetermined sound source.

When the sound waves come from the direction as illustrated in FIG. 11B, it means that the sound waves come from a sound source placed between 0 degrees and 90 degrees with respect to the microphones 23. With such DS beamforming, directional characteristics illustrated in FIG. 11C can be obtained. The directional characteristics are output gain of beamforming plotted for each azimuth.

In the beamforming unit 103 that performs DS beamforming illustrated in FIG. 11B, in the input of adder 132, the phases of signals coming from a predetermined direction, which is a direction between 0 degrees and 90 degrees in this case, match and the signal coming from the direction is enhanced. On the other hand, the signals coming from a direction other than the predetermined direction have phases which do not match each other and are not enhanced compared to the signals coming from the predetermined direction.

With this, as illustrated in FIG. 11C, the gain increases in the azimuth where the sound source exists. The signal D(f,k) output from the beamforming unit 103 has directional characteristics as illustrated in FIG. 11C. Further, the signal D(f,k) output from the beamforming unit 103 is a sound generated by a user and a signal including the voice desired to be extracted (hereinafter, referred to as a target sound) and a noise desired to be suppressed.

The target sound of the signal D(f,k) output from the beamforming unit 103 is enhanced compared to the target sound included in the signals $x_1$(f,k) to $x_m$(f,k) input to the beamforming unit 103. Further, the noise of the signal D(f,k) output from the beamforming unit 103 is reduced compared to the noise included in the signals $x_1$(f,k) to $x_m$(f,k), which are input to the beamforming unit 103.

Next, with reference to FIGS. 12A and 12B, null beamforming (NBF), which is subtraction-type beamforming, will be described.

Figure 12B:
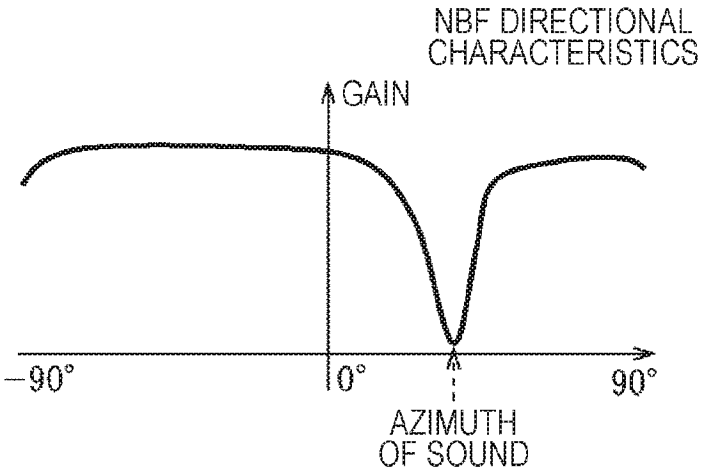
FIGS. 12A and 12B is a are diagrams for explaining beamforming.
Figure 12A:
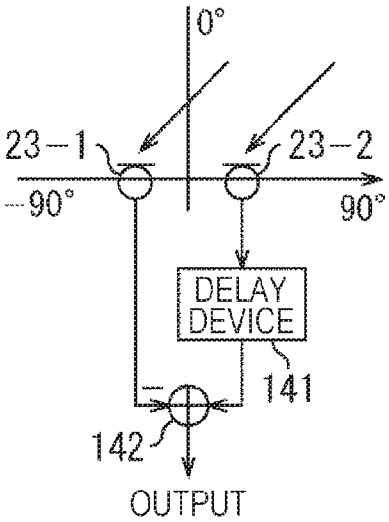

When performing the sound attenuation process on the basis of NULL beamforming, the beamforming unit 103 has a configuration as illustrated in FIG. 12A. The beamforming unit 103 is configured to include a delay device 141 and a subtractor 142. In FIG. 12B, the time-frequency conversion unit 102 is not illustrated. Further, FIG. 12A describes an example that two microphones 23 are used.

The sound signal from the microphone 23-1 is provided to the subtractor 142, and the sound signal from the microphone 23-2 is delayed with a predetermined time by the delay device 141 and provided to the subtractor 142. The configuration for performing Null beamforming and the configuration for performing DS beamforming described above with reference to FIGS. 11A, 11B and 11C are basically the same and the only difference is whether to add by the adder 132 or subtract by the subtractor 142. Thus, the detailed explanation related to the configurations will be omitted here. Further, the explanation related to a part which is the same as that in FIGS. 11A 11B and 11C will be omitted according to need.

When sound waves come from a direction indicated by the arrows in FIG. 12A, the sound waves come to the microphones 23 from a sound source placed between 0 degree and 90 degrees. With such NULL beamforming, the directional characteristics indicated in FIG. 12B will be obtained.

In the beamforming unit 103 that performs the NULL beamforming illustrated in FIG. 12A, in the input of subtractor 142, the phases of signals coming from a predetermined direction, which is a direction between 0 degrees and 90 degrees in this case, match and the signals coming from the direction are attenuated. In logical, as a result of the attenuation, the signals become zero. On the other hand, the signals coming from a direction other than the predetermined direction have phases which do not match each other and are not attenuated compared to the signals coming from the predetermined direction.

With this, as illustrated in FIG. 12B, the gain becomes lowered at the azimuth where the sound source exists. The signal D(f,k) output from the beamforming unit 103 has directional characteristics as illustrated in FIG. 12B. Further, the signal D(f,k) output from the beamforming unit 103 is a signal in which the target sound is canceled and the noise remains.

The target sound of the signal D(f,k) output from the beamforming unit 103 is attenuated compared to the target sound included in the signals $x_1(f,k)$ to $x_m(f,k)$ input to the beamforming unit 103. Further, the noise included in the signals $x_1(f,k)$ to $x_m(f,k)$ input to the beamforming unit 103 is in a similar level with the noise of the signal D(f,k) output from the beamforming unit 103.

The beamforming by the beamforming unit 103 can be expressed by the following expressions (1) to (4).

[Mathematical Formula 1]

$$D(f,k) = C(f,k)X(f,k) \tag{1}$$

$$C(f,k) = [C_1(f,k), C_2(f,k), \ldots, C_M(f,k)] \tag{2}$$

$$C_m(f,k) = \frac{1}{M}\exp(-i2\pi(f/N)f_s d_m \sin\theta/s) \tag{3}$$

$$X(f,k) = [X_1(f,k), X_2(f,k), \ldots, X_M(f,k)]^T. \tag{4}$$

As expressed by the expression (1), signal D(f,k) can be obtained by multiplying the input signals $x_1(f,k)$ to $x_m(f,k)$ and filter coefficient vector C(f,k). The expression (2) is an expression related to the filter coefficient vector C(f,k), and Cm(f,k) (m=1 to M), which is provided from the filter coefficient storage unit 105 and composes the filter coefficient vector C(f,k), is expressed by the expression (3).

In the expression (3), f is a sampling frequency, n is the number of FFTs, dm is a position of microphone m, θ is an azimuth desired to be emphasized, i is an imaginary unit, and s is a constant number that expresses a sound speed. In the expression (4), the superscript ".T" represents a transposition.

The beamforming unit 103 executes beamforming by assigning a value to the expressions (1) to (4). Here, in this example, the description has been given with DS beamforming as an example; however, a sound enhancement process and a sound attenuation process by other beamforming such as adaptive beamforming or a method other than beamforming may be applied to the present technology.

Figure 5:
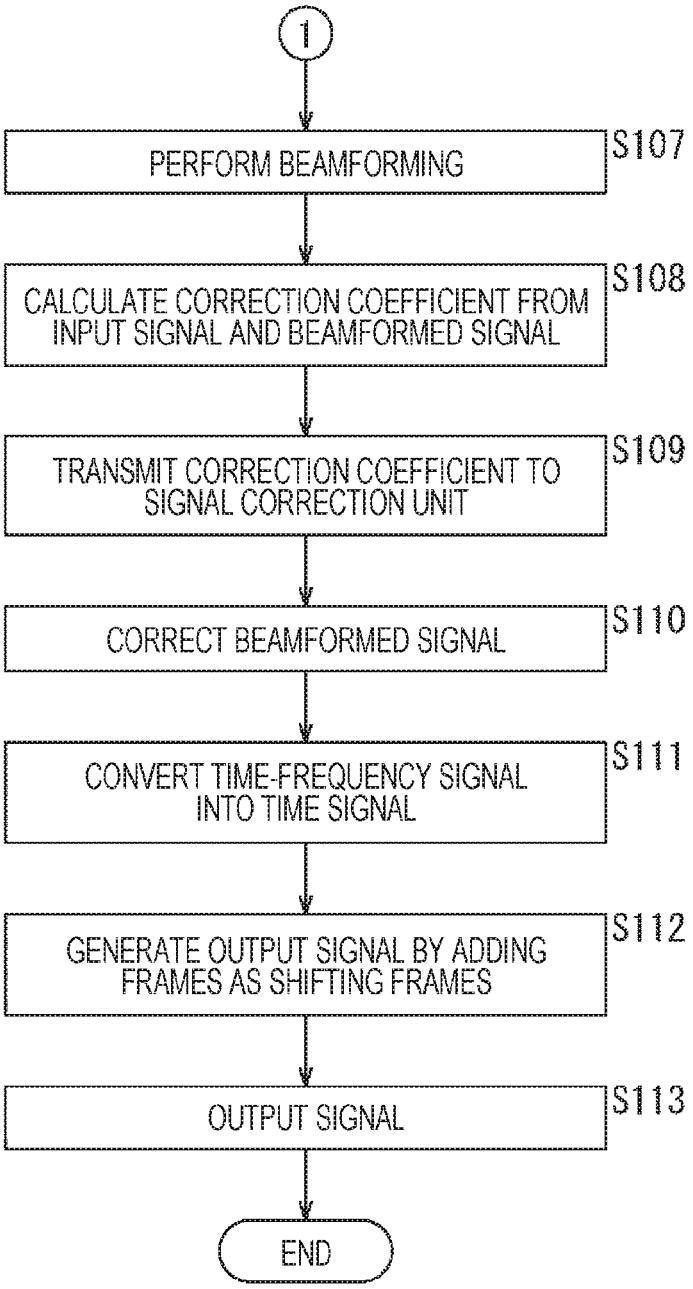
FIG. 5 is a flowchart for explaining the operation of the first-1 sound processing device.

The description refers back to the flowchart of FIG. 5. In step S107, when the beamforming process is performed in the beamforming unit 103, the result is supplied to the signal correction unit 106 and correction coefficient calculation unit 107.

In step S108, the correction coefficient calculation unit 107 calculates a correction coefficient from the input signal and the beamformed signal. In step S109, the calculated correction coefficient is supplied from the correction coefficient calculation unit 107 to the signal correction unit 106.

In step S110, the signal correction unit 106 corrects the beamformed signal by using the correction coefficient. The processes in steps S108 to S110, which are processes in the correction coefficient calculation unit 107 and signal correction unit 106, will be described.

Figure 13:
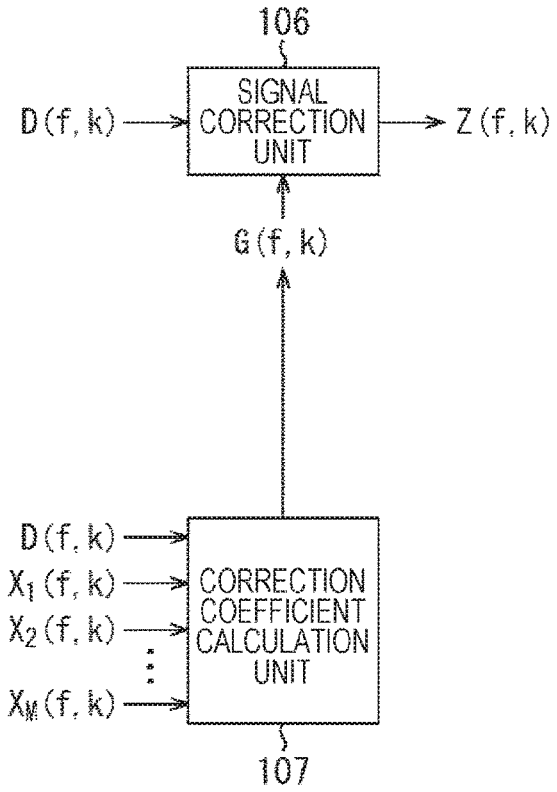
FIG. 13 is a diagram illustrating configurations of a correction coefficient calculation unit and a signal correction unit.

As illustrated in FIG. 13, the beamformed signal D(f,k) is input from the beamforming unit 103 to the signal correction unit 106, and corrected signal Z(f,k) is output. The signal correction unit 106 performs the correction on the basis of the following expression (5).

[Mathematical Formula 2]

$$Z(f,k)=1)(f,k)a(f,k) \tag{5}$$

In the expression (5), G(f,k) represents a correction coefficient provided from the correction coefficient calculation unit 107. The correction coefficient G(f,k) is calculated by the correction coefficient calculation unit 107. As illustrated in FIG. 13, to the correction coefficient calculation unit 107, the signals $x_1(f,k)$ to $x_m(f,k)$ are provided from the time-frequency conversion unit 102 and the beamformed signal D(f,k) is provided from the beamforming unit 103.

The correction coefficient calculation unit 107 calculates a correction coefficient in the following two steps.

First Step: Calculation of Signal Change Rate

Second Step: Determination of Gain Value

First Step: Calculation of Signal Change Rate

Regarding the signal change rate, by using the levels of the input signal x(f,k) from the time-frequency conversion unit 102 and the signal D(f,k) from the beamforming unit 103, a change rate Y(f,k), which indicates how much the signal has changed by beamforming, is calculated on the basis of the following expressions (6) and (7).

[Mathematical Formula 3]

$$Y(f,k) = \frac{|D(f,k)|}{|X_{ave}(f,k)|} \tag{6}$$

$$|X_{ave}(f,k)| = \frac{1}{M}\sum_{m=1}^{M}|X_m(f,k)| \tag{7}$$

As written in the expression (6), the change rate Y(f,k) is obtained by a ratio between an absolute value of the beamformed signal D(f,k) and an absolute value of an average value of the input signals $x_1(f,k)$ to $x_m(f,k)$. The expression (7) is to calculate an average value of the input signals $x_1(f,k)$ to $x_m(f,k)$.

Second Step: Determination of Gain Value

Figure 14:
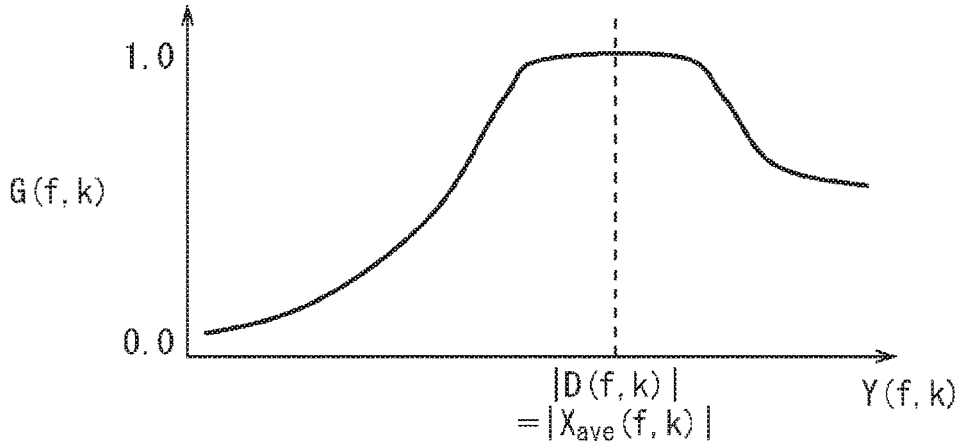
FIG. 14 is a diagram for explaining a correction coefficient.

By using the change rate Y(f,k) obtained in First step, a correction coefficient G(f,k) is determined. The correction coefficient G(f,k) is, for example, determined by using a table illustrated in FIG. 14. The table illustrated in FIG. 14 is an example, which meets the following conditions 1 to 3.

[Mathematical Formula 4]

$$|D(f,k)|<|X_{ave}(f,k)| \qquad \text{Condition 1}$$

$$|D(f,k)>|X_{ave}(f,k)| \qquad \text{Condition 2}$$

$$|D(f,k)|\cong|X_{ave}(f,k)| \qquad \text{Condition 3}$$

The condition 1 is a case that the absolute value of the beamformed signal D(f,k) is equal to or smaller than the absolute value of the average value of the input signals $x_1(f,k)$ to $x_m(f,k)$. In other words, it is a case that the change rate Y(f,k) is equal to or smaller than 1.

The condition 2 is a case that the absolute value of the beamformed signal D(f,k) is equal to or greater than the absolute value of the average value of the input signals $x_1(f,k)$ to $x_m(f,k)$. In other words, it is a case that the change rate Y(f,k) is equal to or greater than 1.

The condition 3 is a case that the absolute value of the beamformed signal D(f,k) and the absolute value of the average value of the input signals $x_1(f,k)$ to $x_m(f,k)$ are the same. In other words, it is a case that the change rate Y(f,k) is 1.

When the condition 1 is satisfied, a correction is performed to further suppress the beamformed signal D(f,k) which has been suppressed in the process by the beamforming unit 103. When the condition 1 is satisfied, the average value of the input signals $x_1(f,k)$ to $x_m(f,k)$ increases due to a sudden noise occurred in a direction where a noise is being suppressed and becomes greater than the beamformed signal D(f,k).

Thus, a correction is performed to further suppress the beamformed signal D(f,k) and to suppress an effect caused by the increased sound due to the sudden noise.

When the condition 2 is satisfied, a correction is performed to suppress the beamformed signal D(f,k) which has been amplified in the process by the beamforming unit 103. When the condition 2 is satisfied, it is a case that a sudden noise occurs in a direction different from the direction where the noise is being suppressed, and the sudden noise is amplified in the beamforming process so that the beamformed signal D(f,k) becomes larger than the average value of the input signals $x_1(f,k)$ to $x_m(f,k)$.

Thus, to suppress the sudden noise which is enhanced by beamforming, a correction to suppress the beamformed signal D(f,k) which has been amplified in the process by the beamforming unit 103 is performed.

When the condition 3 is satisfied, a correction is not performed. In this case, since a sudden noise is not occurring, there is no significant change of sounds and the beamformed signal D(f,k) and the average value of the input signals $x_1(f,k)$ to $x_m(f,k)$ are kept in a substantially same level so that any correction is not needed and a correction is not performed.

Such a correction can prevent a noise from being amplified by mistake when a sudden noise is input, while suppressing the constant noise by the beamforming process.

Here, the table illustrated in FIG. 14 is an example and does not set any limitation. A different table, which is, for example, a table having further detailed conditions other than the three conditions (three ranges) set, may be used. The table may be set by a designer arbitrarily.

The description refers back to the flowchart in FIG. 5. In step S110, the signal which is corrected by the signal correction unit 106 is output to the time-frequency reverse conversion unit 108.

In step S111, the time-frequency reverse conversion unit 108 converts the time-frequency signal z(f,k) from the signal correction unit 106 into a time signal z(n). The time-frequency reverse conversion unit 108 generates an output signal z(n) by adding frames as shifting the frames. As described above with reference to FIGS. 6A and 6B, when a process is performed in the time-frequency conversion unit 102, in the time-frequency reverse conversion unit 108, inverse FFT is performed for each frame, 512 samples output as a result are overlapped as shifting by 256 samples each, and an output signal z(n) is generated.

In step S113, the generated output signal z(n) is output from the time-frequency reverse conversion unit 108 to an unillustrated processing unit in a later stage.

Here, a brief description of an operation of the above described first-1 sound processing device 100 will be provided again with reference to FIG. 15.

Figure 15:
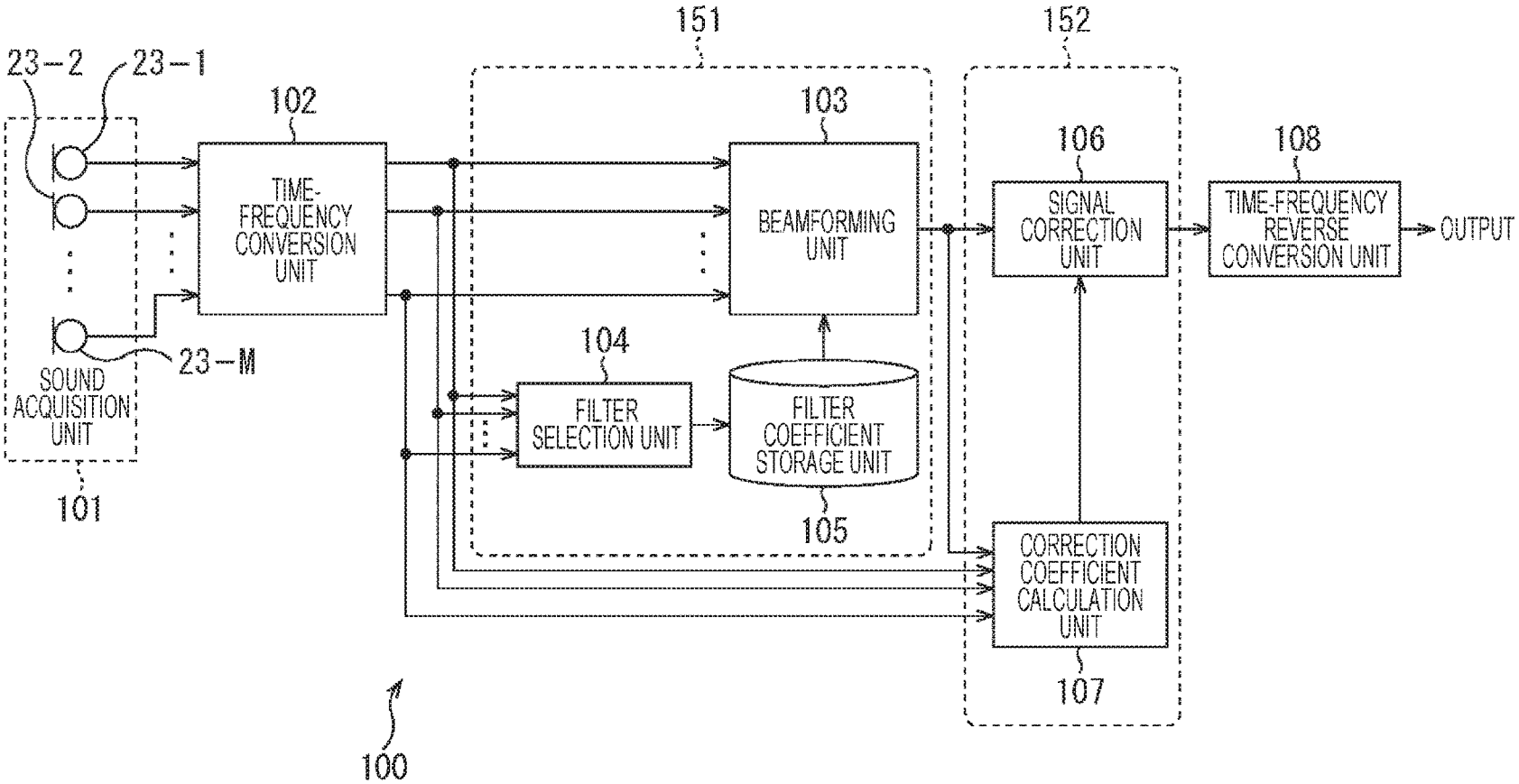
FIG. 15 is a diagram for explaining an operation by the first-1 sound processing device.

FIG. 15 shows the sound processing device 100 illustrated in FIG. 3. In FIG. 15, the sound processing device 100 is divided into two sections, which are a first section 151 including the beamforming unit 103, filter selection unit 104, and filter coefficient storage unit 105 and a second section 152 including the signal correction unit 106 and correction coefficient calculation unit 107.

The first section 151 is a part to reduce a constant noise such as a fan noise of a projector and a noise of an air conditioner, by beamforming. In the first section 151, the filter maintained in the filter coefficient storage unit 105 is a linear filter and this realizes a high quality sound and a stable operation.

Further, by the process in the first section 151, a follow-up process is executed to select a most preferable filter according to need when an azimuth of a noise changes or when the position of the sound processing device 100 itself changes for example, and its follow-up speed (accumulation time to create a histogram) can be set by the designer arbitrarily. When the follow-up speed is set properly, the process can be performed without a sudden change of the sound and an uncomfortable feeling caused during listening, which may occur in a case of adaptive beamforming for example.

The second section 152 is a part to reduce a sudden noise which comes from a direction other than the azimuth being attenuated by beamforming. In addition, a process to further reduce the constant noise which has been reduced by beamforming is executed according to the situation.

Figure 16:
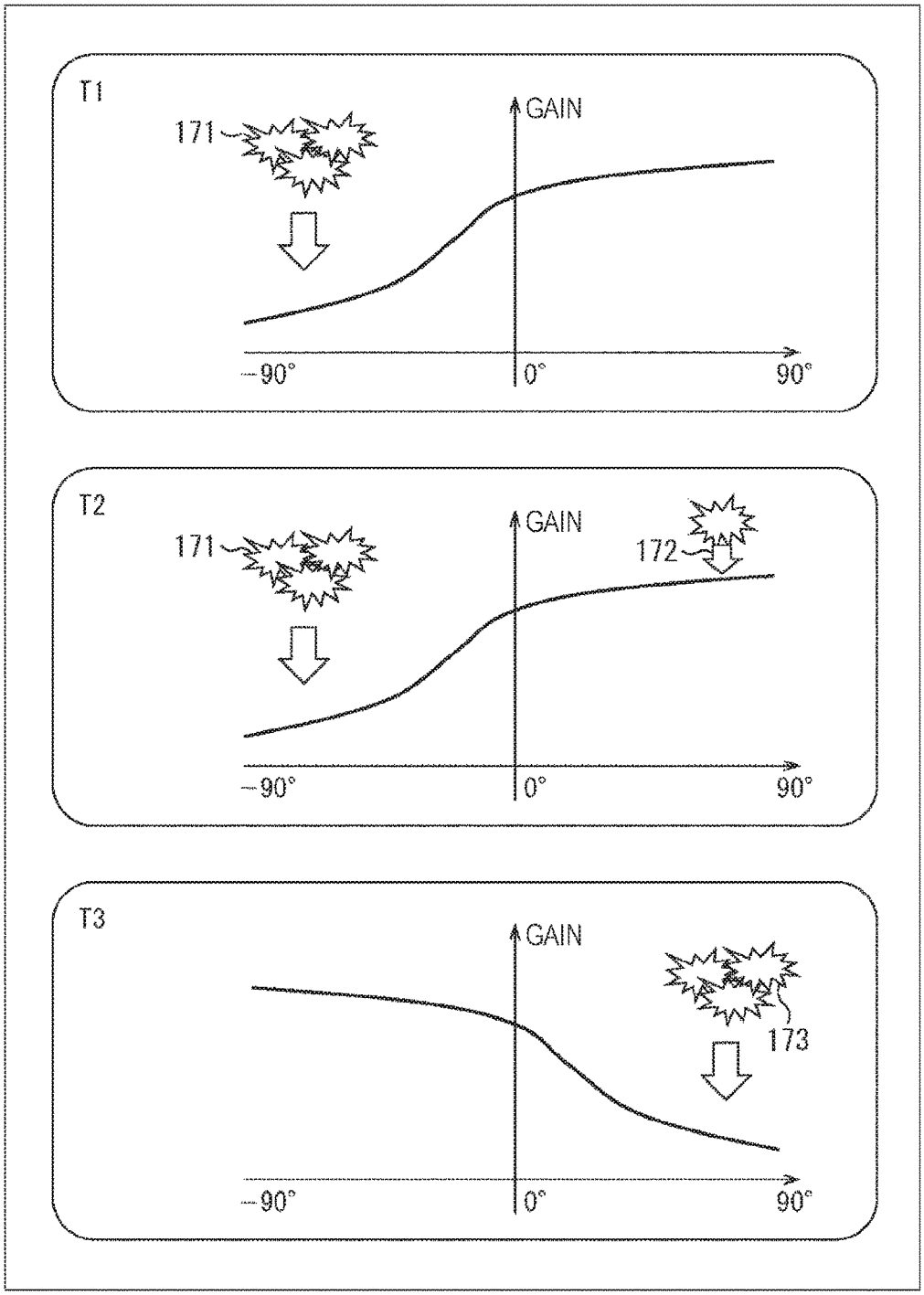
FIG. 16 is a diagram for explaining the operation by the first-1 sound processing device.

Here, operations by the first section 151 and second section 152 will be further described with reference to FIG. 16. FIG. 16 is a diagram illustrating a relationship of filters set at timings and noises.

At time T1, the filter A described above with reference to FIG. 8 is applied. At time T1, the filter A is applied since it is determined that a constant noise 171 is in a direction of −90 degrees. At time T1, by applying the filter A, the sound in the direction where the constant noise 171 exists is suppressed and a sound in which the constant noise 171 is being suppressed can be obtained.

At time T2, it is assumed that a sudden noise 172 occurs in a direction of 90 degrees. Also at time T2, the filter A is applied and the sound from the direction of 90 degrees is amplified (in a condition with a high gain). When a sudden noise occurs in the direction being amplified, the sudden noise is also amplified.

However, since a correction to reduce the gain by the increased amount is performed by the signal correction unit 106, the final output sound is a sound in which an increased sound due to sudden noise is prevented.

In other words, in this case, even when a process to amplify the sudden noise is performed in the first section 151 (FIG. 15), a correction to suppress the amplified amount is performed in the second section 152 and, as a result, an effect due to the sudden noise can be suppressed.

At time T3, the constant noise moves since the orientation of the sound processing device 100 is changed or the sound source of the noise moves for example, and this causes a condition that the constant noise 173 is in the direction of 90 degrees. When a predetermined period of time, that is, the time for accumulating to create a histogram, has passed since the above condition was caused, the filter is switched from the filter A to filter C to react the change.

When the sound source of the noise moves in this manner, the filter can be properly switched according to the direction of the sound source and frequent filter switching can be prevented.

According to the present technology that can perform a process in this manner, while suppressing a constant noise, a sudden noise, which occurs in a different direction, can be also reduced. Further, the noise can be suppressed even when the noise is not generated at a point sound source but is widespread in a space. Further, stable operation can be achieved without a rapid change in a sound quality caused in an adaptive beamforming of the related art.

Further, since it is not needed to detect a sound zone, the above described effects can be achieved regardless of the accuracy of the sound zone detection.

Further, according to the present technology, for example, since a target sound can be obtained only with a small omnidirectional microphone and signal processing without using a directional microphone (shotgun microphone) which has a large body, this helps to make a smaller and lighter product. Further, the present technology may also be applied in a case that a directional microphone is used and may also operate in the case that the directional microphone is used, so that a higher performance can be expected.

Further, since the desired sound can be collected as reducing the effect due to the constant noise and sudden noise, an accuracy of sound processing such as a sound recognition rate can be improved.

<Internal Configuration and Operation of First-2 Sound Processing Device>

Next, a configuration and an operation of a first-2 sound processing device will be described. The above described first-1 sound processing device 100 (FIG. 3) selects a filter by using the sound signal from the time-frequency conversion unit 102; however, the first-2 sound processing device 200 (FIG. 17) is different in that a filter is selected by using information input from outside.

Figure 17:
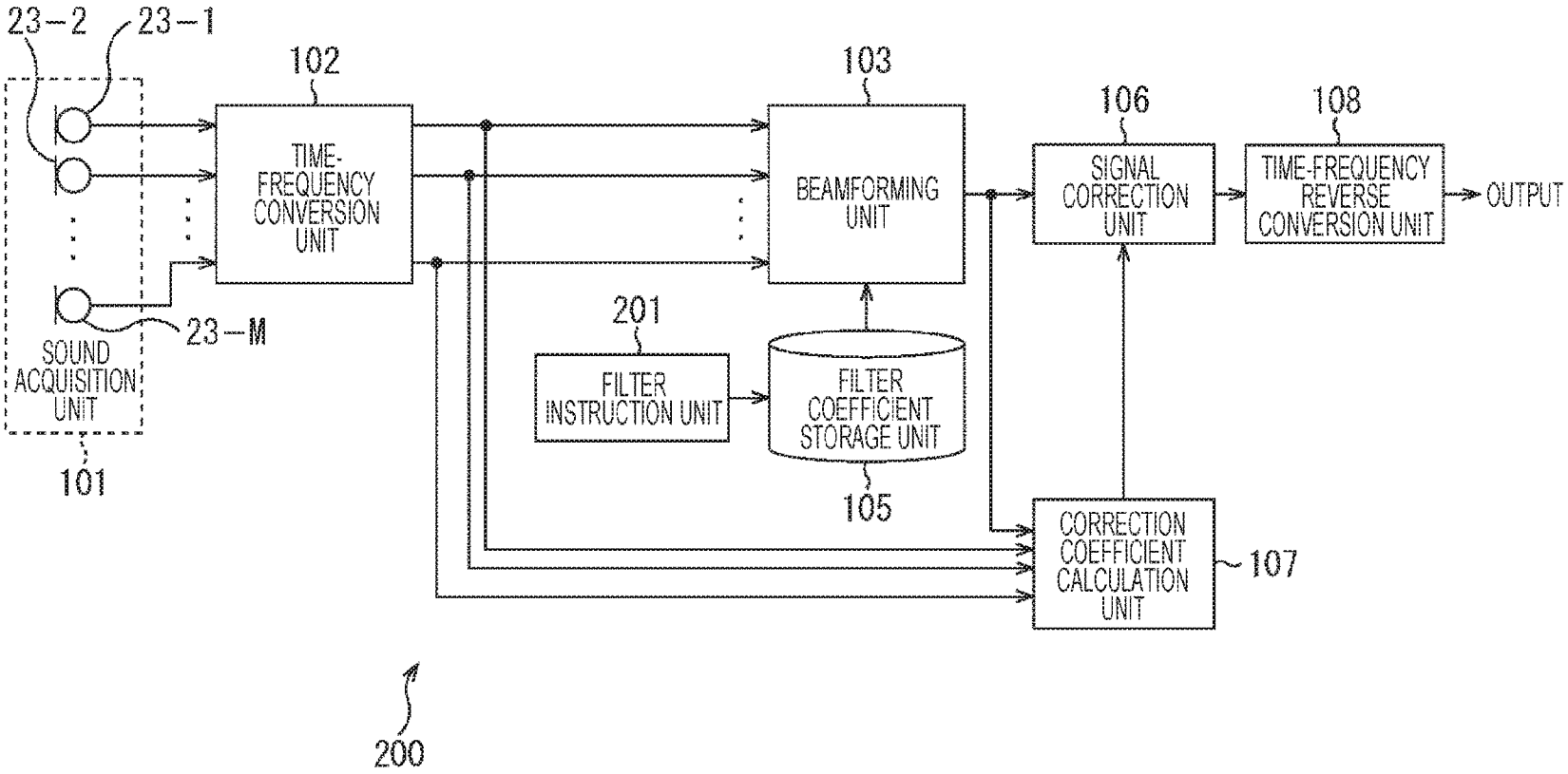
FIG. 17 is a diagram illustrating an internal configuration of a first-2 sound processing device.

FIG. 17 is a diagram illustrated a configuration of the first-2 sound processing device 200. The parts in the sound processing device 200 illustrated in FIG. 17 which have the same function with that in the first-1 sound processing device 100 illustrated in FIG. 3 are applied with the same reference numerals and explanation thereof will be omitted.

The sound processing device 200 illustrated in FIG. 17 has a configuration that information needed to select a filter is provided to a filter instruction unit 201 from outside and has a configuration that a signal from the time-frequency conversion unit 102 is not provided to the filter instruction unit 201, which is different from the configuration of the sound processing device 100 illustrated in FIG. 3.

As the information, which is needed to select a filter and provided to the filter instruction unit 201, for example, information input by the user is used. For example, there may be a configuration that a user selects a direction of a sound the user desires to collect and the selected information is input.

Figure 18:
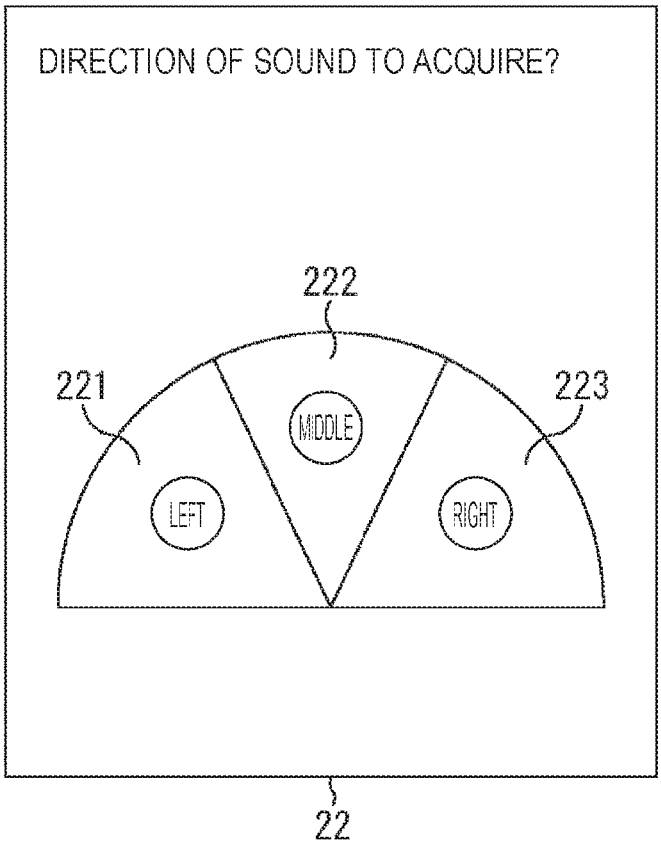
FIG. 18 is a diagram illustrating an example of a screen shown on a display.

For example, a screen illustrated in FIG. 18 is displayed on a display 22 of a mobile phone 10 (FIG. 1) including the sound processing device 200. In the screen example illustrated in FIG. 18, a message "Direction of sound to collect?" is displayed in an upper part and options to select one of the three areas are displayed under the message.

The options are an area 221 on the left, an area 222 in the middle, and an area 223 on the right. The user looks at the message and the options and selects a direction of the sound the user desires to collect from the options. For example, when the sound desired to be collected is in the middle (front), the area 222 is selected. Such a screen may be shown to the user and the user may select a direction of the sound the user desires to collect.

In this example, a direction of the sound to be collected is selected; however, for example, a message like "Which direction a large noise exists in?" may be displayed to let the user select a direction of a noise.

Further, a list of filters may be displayed, a user may select a filter from the list, and the selected information may be input. For example, although it is not illustrated, a list of filters may be displayed, on the display 22 (FIG. 1), in a manner that the user can recognize in what condition a filter is used such as "filter used for a case that there is a large noise on the right" or "filter used for collecting a sound from a wide area" so that the user can make a selection.

Or, the sound processing device 200 may include a switch for switching a filter and information of an operation on the switch may be input.

The filter instruction unit 201 obtains such information and instructs a filter coefficient index used in beamforming to the filter coefficient storage unit 105, on the basis of the obtained information.

Figure 19:
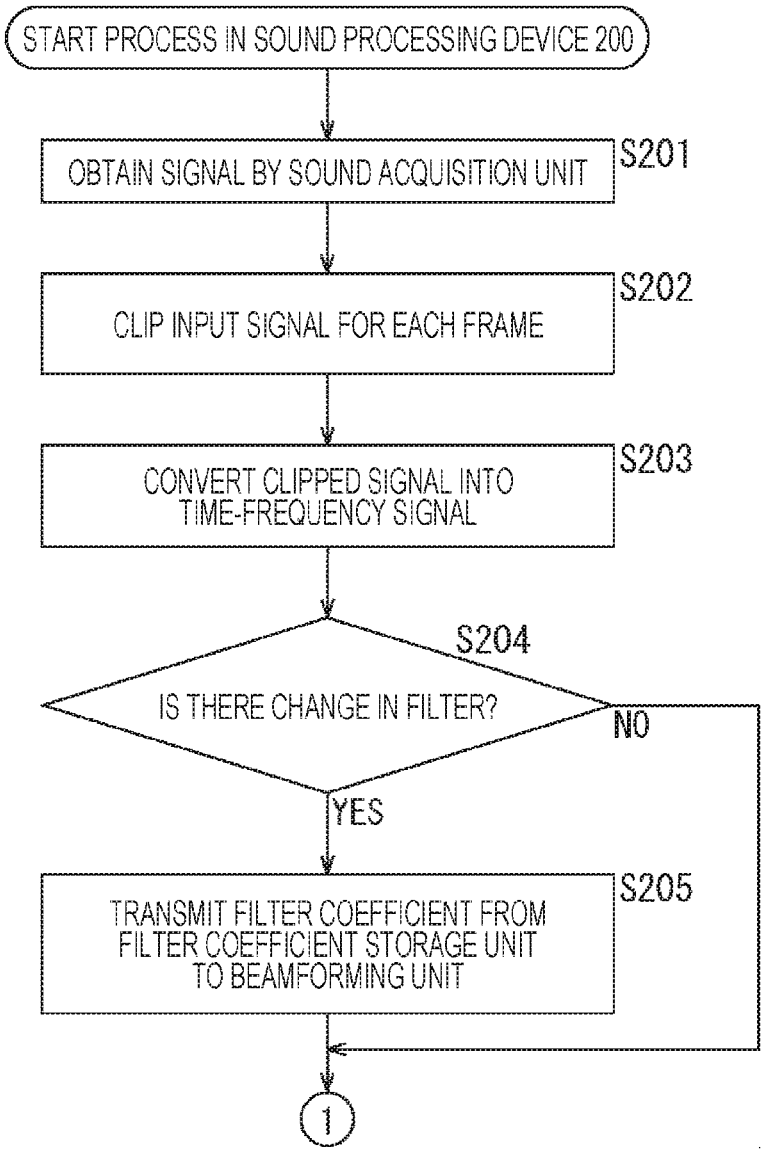
FIG. 19 is a flowchart for explaining an operation by the first-2 sound processing device.

An operation of the sound processing device 200, which has the above described configuration, will be described with reference to the flowcharts in FIGS. 19 and 20. Since its basic operation is similar to that of the sound processing device 100 illustrated in FIG. 3, the explanation of the similar operation will be omitted.

Each process described in steps S201 to S203 (FIG. 19) is performed similarly to each process in steps S101 to 103 of FIG. 4.

In the first-1 sound processing device 100, a process to determine a filter is executed in step S104; however, such a process is not needed in the first-2 sound processing device 200 and the process is omitted in the process flow. Then, in the first-2 sound processing device 200, in step S204, it is determined whether or not there is an instruction to change the filter.

Figure 20:
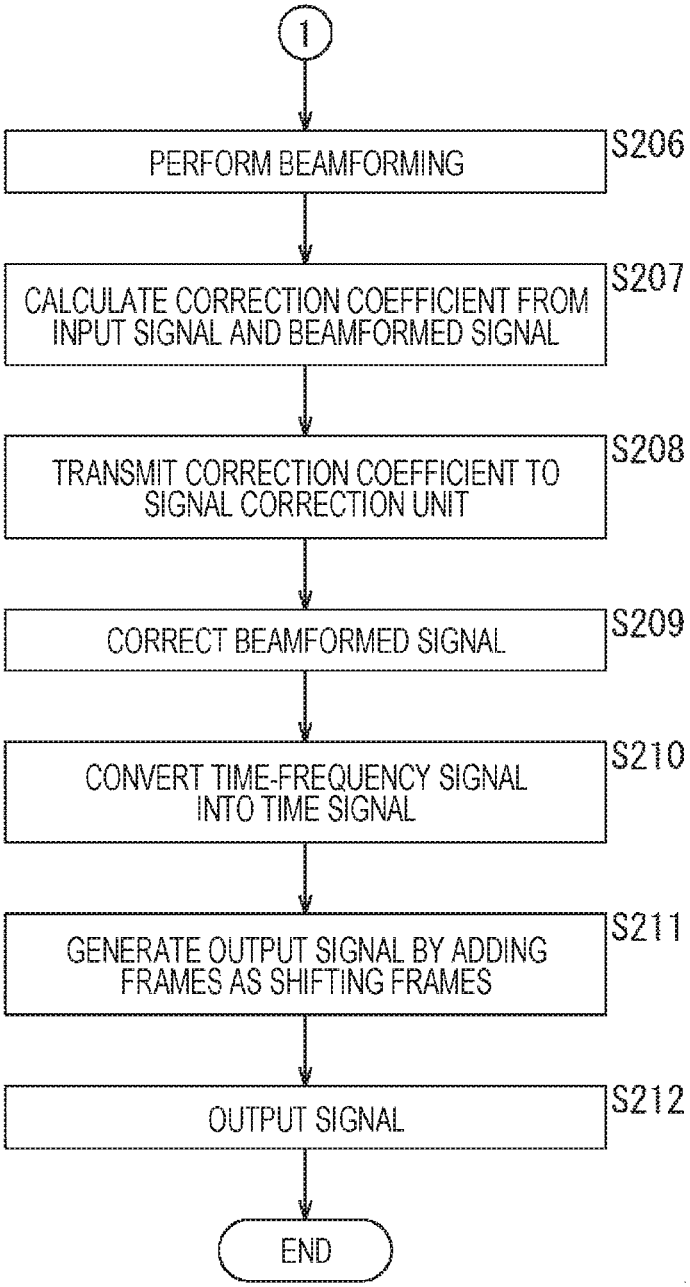
FIG. 20 is a flowchart for explaining the operation by the first-2 sound processing device.

In step S204, when it is determined that there is an instruction to change the filter, for example, when an instruction is received from the user in the above described method, the process proceeds to step S205, and, when it is determined that there is not an instruction to change the filter, the process in step S205 is skipped and the process proceeds to step S206 (FIG. 20).

The process in step S205, similarly to step S106 (FIG. 4), a filter coefficient is read from the filter coefficient storage unit 105 and a process of transmitting the filter coefficient to the beamforming unit 103 is executed.

Since each process in steps S206 to S212 (FIG. 20) is performed basically similarly to each process in steps S107 to S113 of FIG. 5, the explanation thereof will be omitted.

In this manner, in the first-2 sound processing device 200, the information used to select a filter is input from outside (by a user). Also in the first-2 sound processing device 200, similarly to the first-1 sound processing device 100, a proper filter can be selected and a sudden noise or the like can be properly handled so that an accuracy of sound processing such as a sound recognition rate can be improved.

<Internal Configuration and Operation of Second Sound Processing Device>

<Internal Configuration of Second-1 Sound Processing Device>

Figure 21:
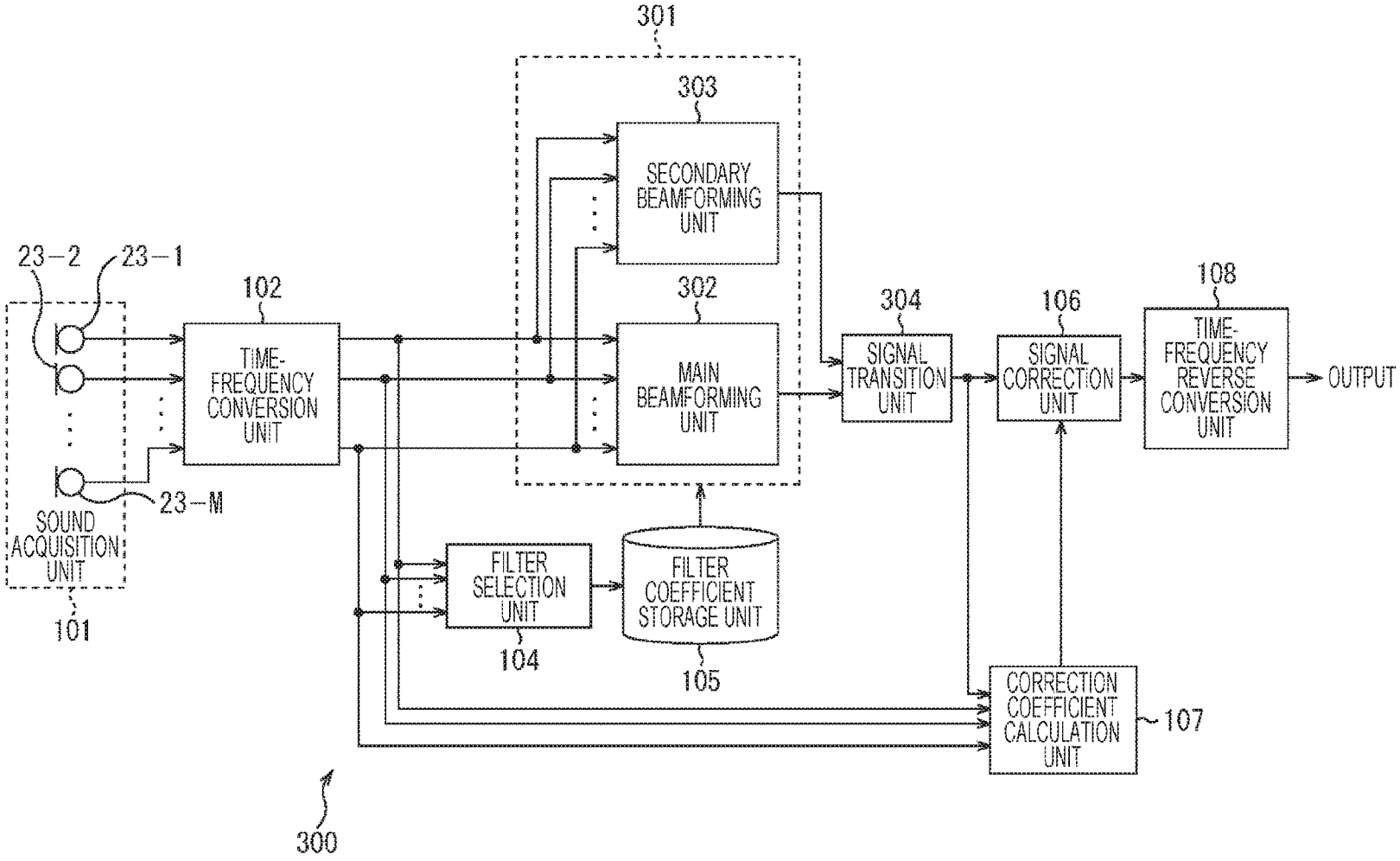
FIG. 21 is a diagram illustrating an internal configuration of a second-1 sound processing device.

FIG. 21 is a diagram illustrating a configuration of a second-1 sound processing device 300. The sound processing device 300 is provided inside the mobile phone 10 and composes a part of the mobile phone 10. The sound processing device 300 illustrated in FIG. 21 includes a sound collection unit 101, a time-frequency conversion unit 102, a filter selection unit 104, a filter coefficient storage unit 105, a signal correction unit 106, a correction coefficient calculation unit 107, a time-frequency reverse conversion unit 108, a beamforming unit 301, and a signal transition unit 304.

The beamforming unit 301 includes a main beamforming unit 302 and a secondary beamforming unit 303. The parts having a function similar to that in the sound processing device 100 illustrated in FIG. 3 are illustrated with similar reference numerals and the explanation thereof will be omitted.

The sound processing device 300 according to the second embodiment is different from the sound processing device 100 according to the first embodiment in that the beamforming unit 103 (FIG. 3) includes the main beamforming unit 302 and secondary beamforming unit 303. Further, there is a difference that the signal transition unit 304 for switching signals from the main beamforming unit 302 and secondary beamforming unit 303 is included.

Figure 22:
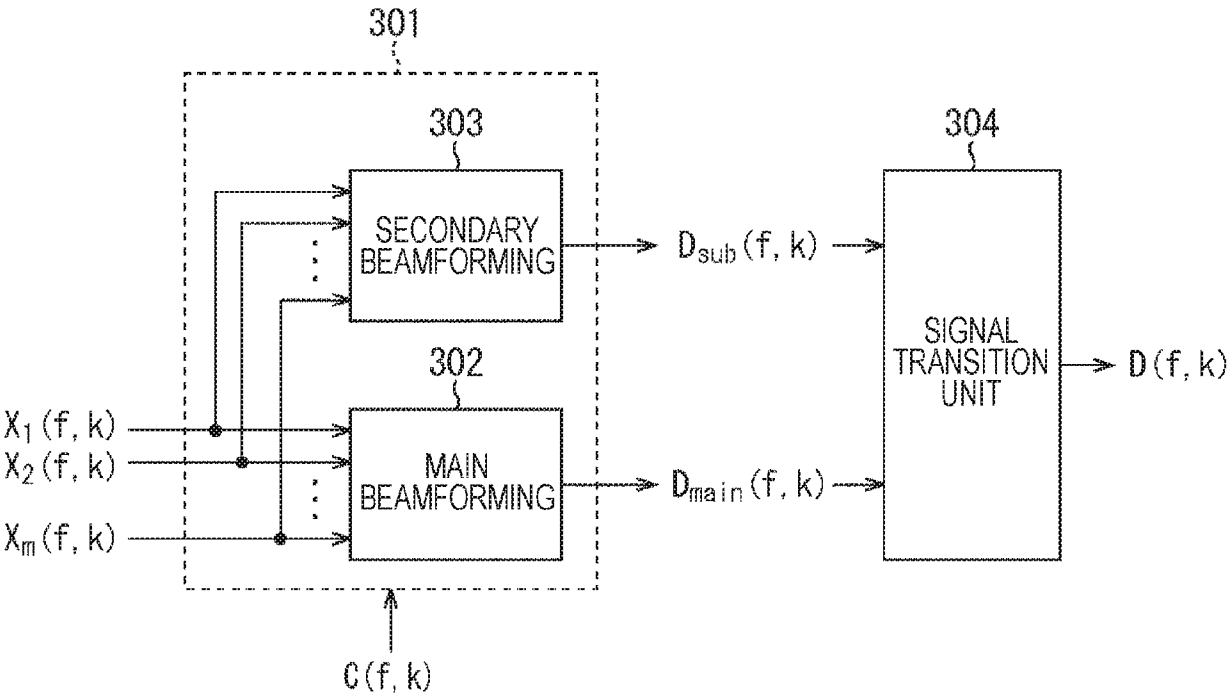
FIG. 22 is a diagram illustrating a configuration of a beamforming unit.

As illustrated in FIGS. 21 and 22, the beamforming unit 301 includes the main beamforming unit 302 and secondary beamforming unit 303, and signals $x_1(f,k)$ to $x_m(f,k)$ which are converted into signals of a frequency range are provided to the main beamforming unit 302 and secondary beamforming unit 303 from the time-frequency conversion unit 102.

The beamforming unit 301 includes the main beamforming unit 302 and secondary beamforming unit 303 to prevent a sound from being changed at a moment when the filter coefficient C(f,k) provided from the filter coefficient storage unit 105 is switched. The beamforming unit 301 performs the following operation.

Normal condition (a condition that filter coefficient C(f,k) is not switched)

Only the main beamforming unit 302 of the beamforming unit 301 operates and the secondary beamforming unit 303 stays without operating.

Case that the filter coefficient C(f,k) is switched

Both of the main beamforming unit 302 and secondary beamforming unit 303 in the beamforming unit 301 operate, the main beamforming unit 302 executes a process with a previous filter coefficient (a filter coefficient before switching), and the secondary beamforming unit 303 executes a process with a new filter coefficient (a filter coefficient after the switching).

After a predetermined frame (a predetermined period of time), which is t frame in this example, has passed, the main beamforming unit 302 starts an operation with a new filter coefficient and the secondary beamforming unit 303 stops operation. Here, "t" is the number of transition frames and is set arbitrarily.

From the beamforming unit 301, when the filter coefficient C(f,k) is switched, beamformed signals are each output from the main beamforming unit 302 and secondary beamforming unit 303. The signal transition unit 304 executes a process to mix the signals each output from the main beamforming unit 302 and secondary beamforming unit 303.

When mixing, the signal transition unit 304 may perform the process with a fixed mixing ratio or may perform the process as changing the mixing ratio. For example, immediately after the filter coefficient C(f,k) is switched, the process is performed with a mixing ratio with more signals from the main beamforming unit 302 than signals from the secondary beamforming unit 303, and after that, the ratio to mix the signals from the main beamforming unit 302 is gradually reduced, and the mixing ratio is switched to a mixing ratio with more signals from the secondary beamforming unit 303.

In this manner, when the filter coefficient is changed, by mixing the respective signals from the main beamforming unit 302 and secondary beamforming unit 303 with a predetermined mixing ratio, even if the filter coefficient changes, the user does not have to have an uncomfortable feeling in the output signals. The signal transition unit 304 performs the following operation.

Normal condition (a condition that the filter coefficient C(f,k) is not changed)

The signals from the main beamforming unit 302 are simply output to the signal correction unit 106.

Until t frame passes after the filter coefficient C(f,k) is switched

The signals from the main beamforming unit 302 and the signals from the secondary beamforming unit 303 are mixed on the basis of the following expression (8) and the mixed signals are output to the signal correction unit 106.

[Mathematical Formula 5]

$$D(f,k)=\alpha D_{main}(f,k)+(1-\alpha)D_{sub}(f,k) \quad (8)$$

In the expression (8), a is a coefficient that takes a value from 0.0 to 1.0, and is a value set by the designer arbitrarily. The coefficient $\alpha$ is a fixed value and a same value may be used until t frame passes after the filter coefficient C(f,k) is switched.

Or, the coefficient $\alpha$ may be a variable value and may be a value which is set to be 1.0 when the filter coefficient C(f,k) is switched, reduces as the time passes, and set to be 0.0 when t frame passes, for example.

According to the expression (8), the output signal D(f,k) from the signal transition unit 304 after the filter coefficient has been switched is a signal which is calculated by adding a signal that a is multiplied to the signal $D_{main}(f,k)$ from the main beamforming unit 302 and a signal that $(1-\alpha)$ is multiplied to the signal $D_{sub}(f,k)$ from the secondary beamforming unit 303.

An operation of the sound processing device 300 including the main beamforming unit 302, secondary beamforming unit 303, as well as the signal transition unit 304 in this manner will be described with reference to the flowcharts of FIGS. 23 and 24. Here, the parts having the same function with that in the sound processing device 100 according to the first-1 embodiment basically perform the same processes and the explanation thereof will be omitted according to need.

In steps S301 to S305, processes by the sound collection unit 101, time-frequency conversion unit 102, and filter selection unit 104 are executed. Since the processes in steps S301 to S305 are performed similarly to the processes in steps S101 to S105 (FIG. 4), the explanation thereof will be omitted.

In step S305, when it is determined that the filter is not changed, the process proceeds to step S306. In step S306, the main beamforming unit 302 performs a beamforming process by using a filter coefficient C(f,k) which is set at the time. In other words, the process with the filter coefficient which is set at the time is continued.

The beamformed signal from the main beamforming unit 302 is supplied to the signal transition unit 304. In this case, since the filter coefficient is not changed, the signal transition unit 304 simply outputs the supplied signal to the signal correction unit 106.

In step S312, the correction coefficient calculation unit 107 calculates a correction coefficient from an input signal and a beamformed signal. Since each process performed by the signal correction unit 106, correction coefficient calculation unit 107, and time-frequency reverse conversion unit 108 in steps S312 to S317 is performed similarly to the process executed by the first-1 sound processing device 100 insteps S108 to S113 (FIG. 5), the explanation thereof will be omitted.

On the other hand, in step S305, when it is determined that a filter is changed, the process proceeds to step S306. In step S306, the filter coefficient is read from the filter coefficient storage unit 105 and supplied to the secondary beamforming unit 303.

In step S307, the beamforming process is executed by each of the main beamforming unit 302 and secondary beamforming unit 303. The main beamforming unit 302 executes beamforming with a filter coefficient before the filter is changed (hereinafter, referred to as a previous filter coefficient), and the secondary beamforming unit 303 executes beamforming with a filter coefficient after the filter is changed (hereinafter, referred to as a new filter coefficient).

In other words, the main beamforming unit 302 continues the beamforming process without changing the filter coefficient, and the secondary beamforming unit 303 starts a beamforming process in step S307 by using a new filter coefficient provided from the filter coefficient storage unit 105.

Figure 24:
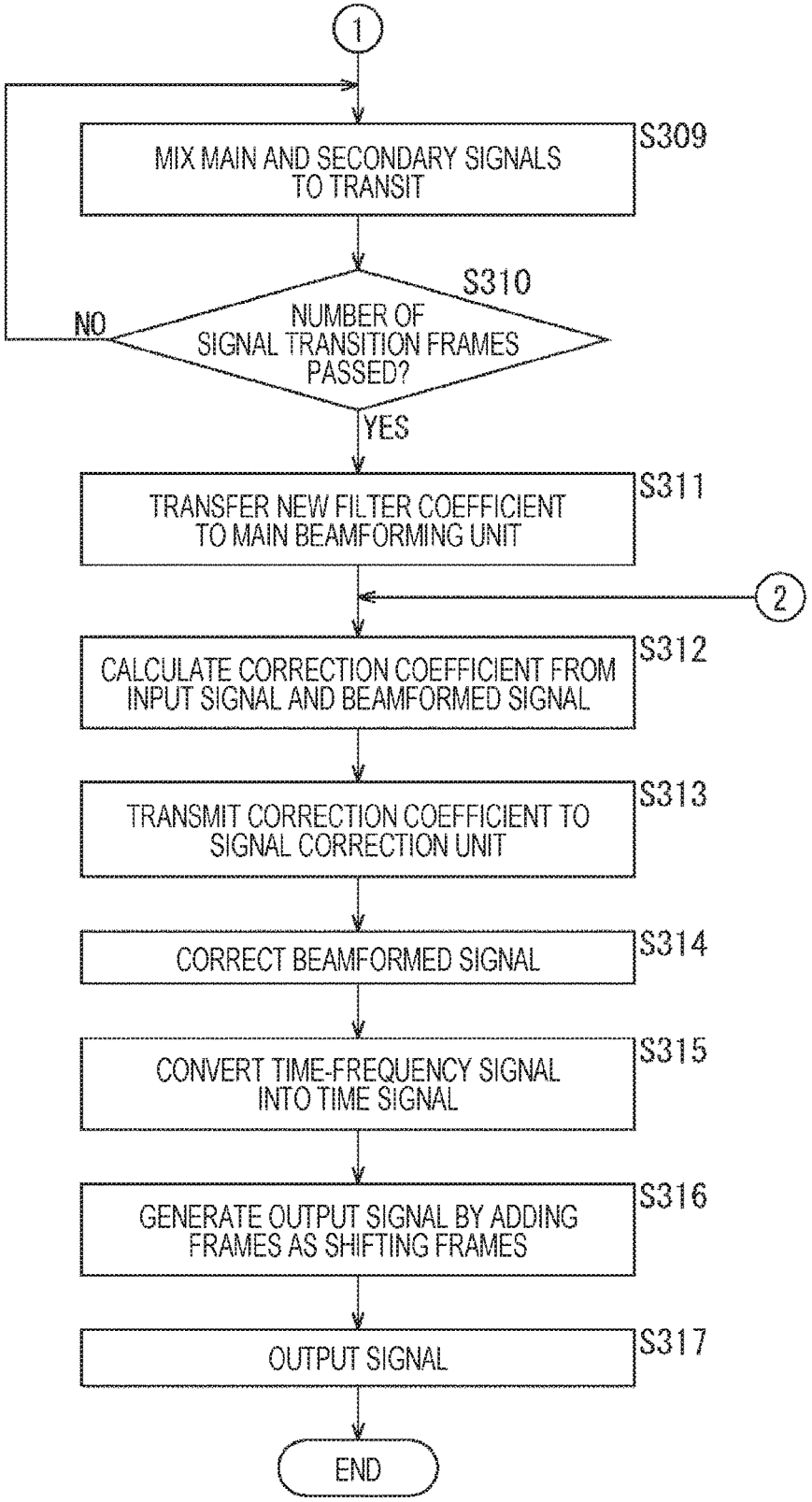
FIG. 24 is a flowchart for explaining the operation by the second-1 sound processing device.

When the beamforming process is performed in each of the main beamforming unit 302 and secondary beamforming unit 303, the process proceeds to step S309 (FIG. 24). In step S309, the signal transition unit 304 mixes the signal from the main beamforming unit 302 and the signal from the secondary beamforming unit 303 on the basis of the above expression (8) and outputs the mixed signal to the signal correction unit 106.

In step S310, it is determined whether or not the number of signal transition frames has passed and, when it is determined that the number of signal transition frames has not passed, the process returns to step S309 and repeats the processes in step S309 and subsequent steps. In other words, until it is determined that the number of signal transition frames has passed, the signal transition unit 304 performs a process of mixing the signal from the main beamforming unit 302 and the signal from the secondary beamforming unit 303 and outputting the signals.

Here, since the time when it is determined that the filter coefficient is switched and until it is determined that the number of the signal transition frames has passed, processes in step S312 to S317 are performed on the output from the signal transition unit 304 and the signal are continued to be supplied to an unillustrated processing unit in a later stage.

In step S310, when it is determined that the number of the signal transition frames has passed, the process proceeds to step S311. In step S311, a process to transfer a new filter coefficient to the main beamforming unit 302 is executed. After that, the main beamforming unit 302 starts a beamforming process by using the new filter coefficient, and the secondary beamforming unit 303 stops the beamforming process.

By mixing the signal from the main beamforming unit 302 and the signal from the secondary beamforming unit 303 in this manner when the filter coefficient is changed, the output signal can be prevented from being suddenly changed and the user does not have to have an uncomfortable feeling in the output signals even if the filter coefficient is changed.

Further, the above described effects of the first-1 sound processing device 100 and first-2 sound processing device 200 can be obtained with the second-1 sound processing device 300.

<Internal Configuration and Operation of Second-2 Sound Processing Device>

Next, an internal configuration and operation of a second-2 sound processing device will be described. The above described second-1 sound processing device 300 (FIG. 21) selects a filter by using the sound signal from the time-frequency conversion unit 102; however the second-2 sound processing device 400 (FIG. 25) has a difference that a filter is selected by using information input from outside.

Figure 25:
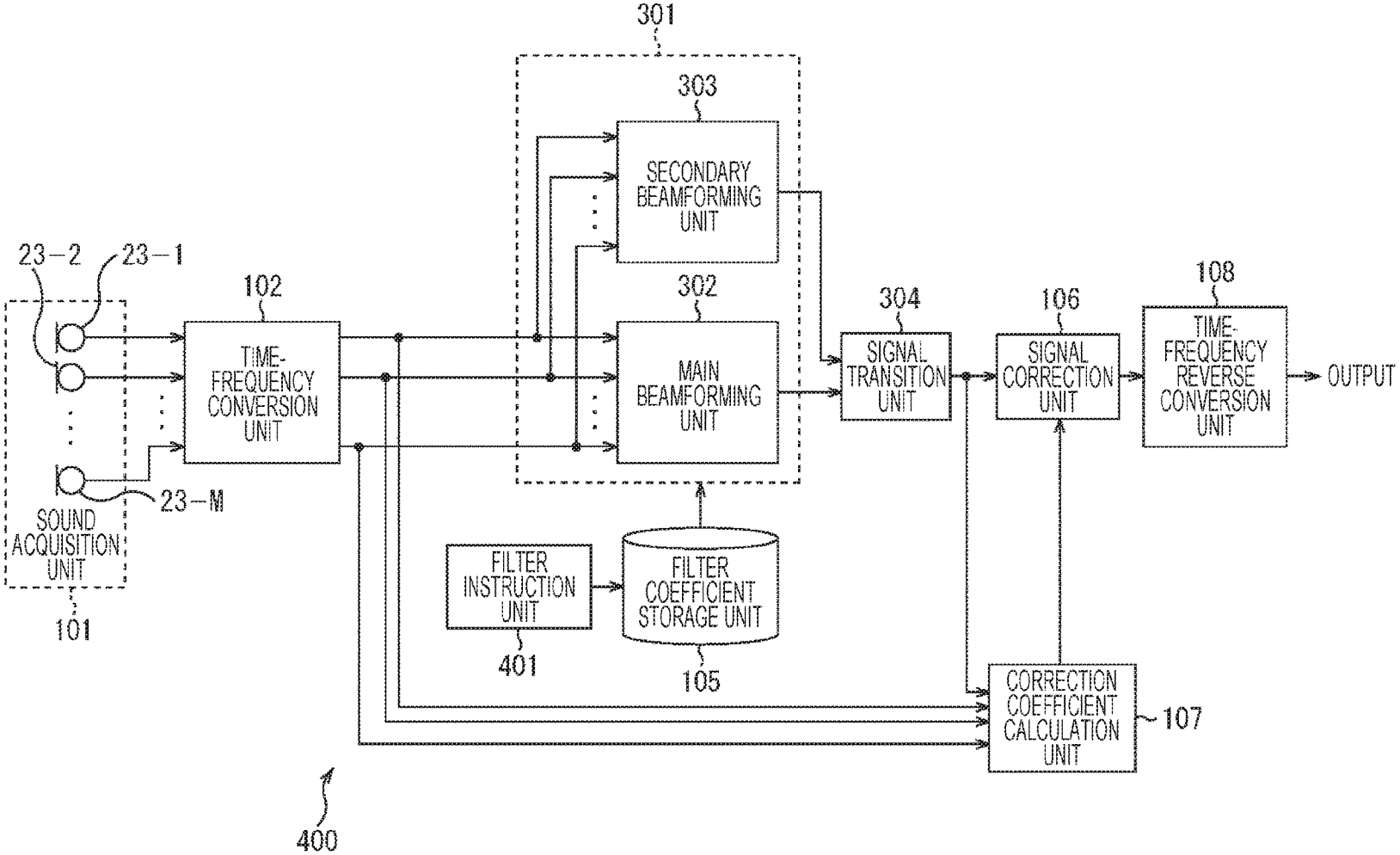
FIG. 25 is a diagram illustrating an internal configuration of a second-2 sound processing device.

FIG. 25 is a diagram illustrating a configuration of the second-2 sound processing device 400. In the sound processing device 400 illustrated in FIG. 25, the parts having the same function as that in the second-1 sound processing device 300 illustrated in FIG. 21 are applied with the same reference numerals and the explanation thereof will be omitted.

The sound processing device 400 illustrated in FIG. 25 has a configuration that information needed to select a filter is supplied to the filter instruction unit 201 from outside, the signal from the time-frequency conversion unit 102 is not supplied to the filter instruction unit 201, which is different from the configuration of the sound processing device 300 illustrated in FIG. 21.

The filter instruction unit 401 may have a configuration same as that of the filter instruction unit 201 of the first-2 sound processing device 200.

As the information, which is needed to select a filter and supplied to the filter instruction unit 401, for example, information input by a user is used. For example, there may be a configuration that the user is made to select a direction of a sound the user desires to collect and the selected information is input.

For example, the above described screen illustrated in FIG. 18 may be displayed on the display 22 of the mobile phone 10 (FIG. 1) including the sound processing device 400 and an instruction from the user may be accepted by using the screen.

Or, a list of filters may be displayed, the user may select a filter from the list, and the selected information may be input. Or, a switch (not illustrated) for switching filters may be provided to the sound processing device 400 and information of an operation on the switch may be input.

The filter instruction unit 401 obtains such information and, instructs from the obtained information, a filter coefficient index used in beamforming to the filter coefficient storage unit 105.

Figure 26:
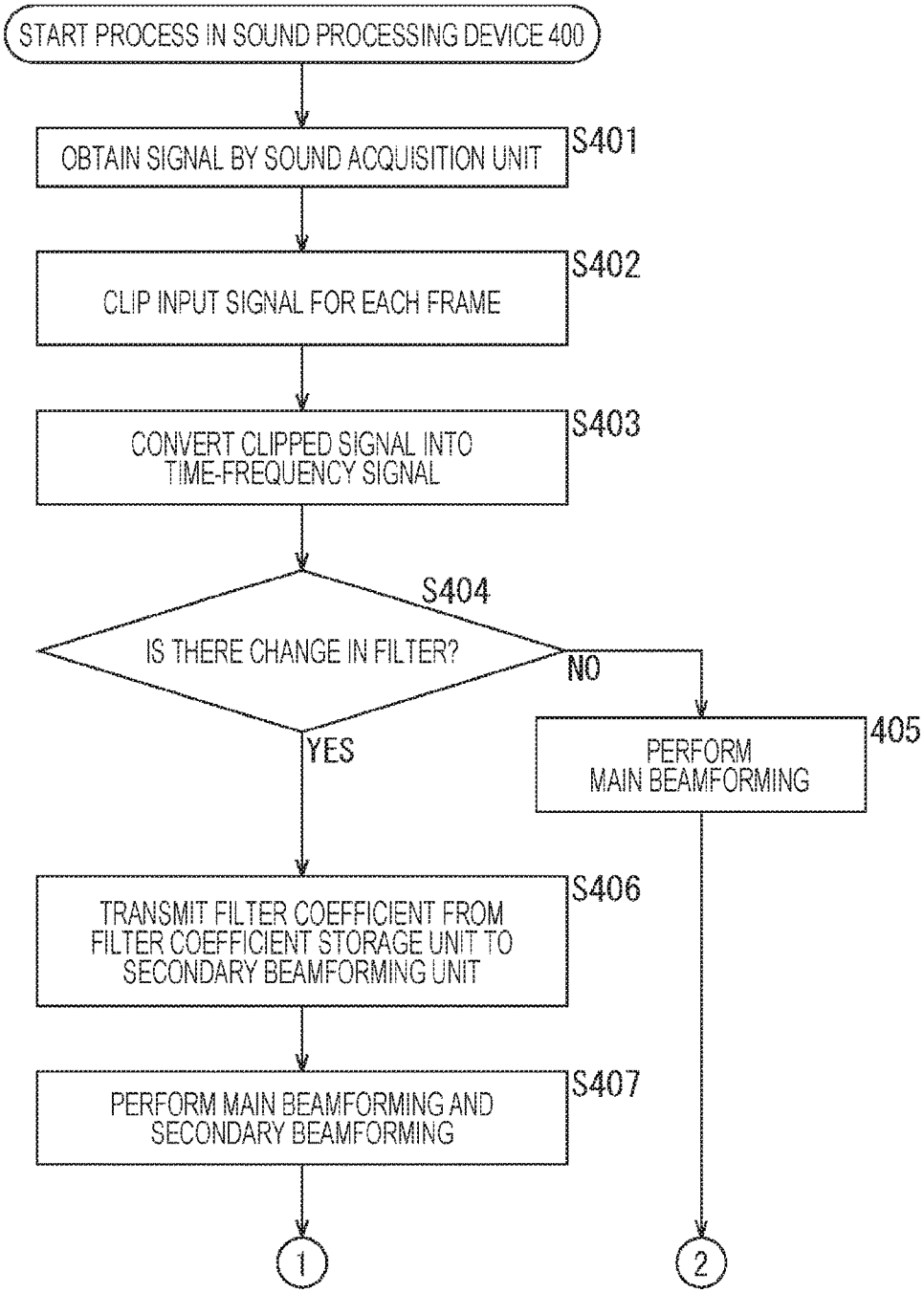
FIG. 26 is a flowchart for explaining an operation by the second-2 sound processing device.
Figure 27:
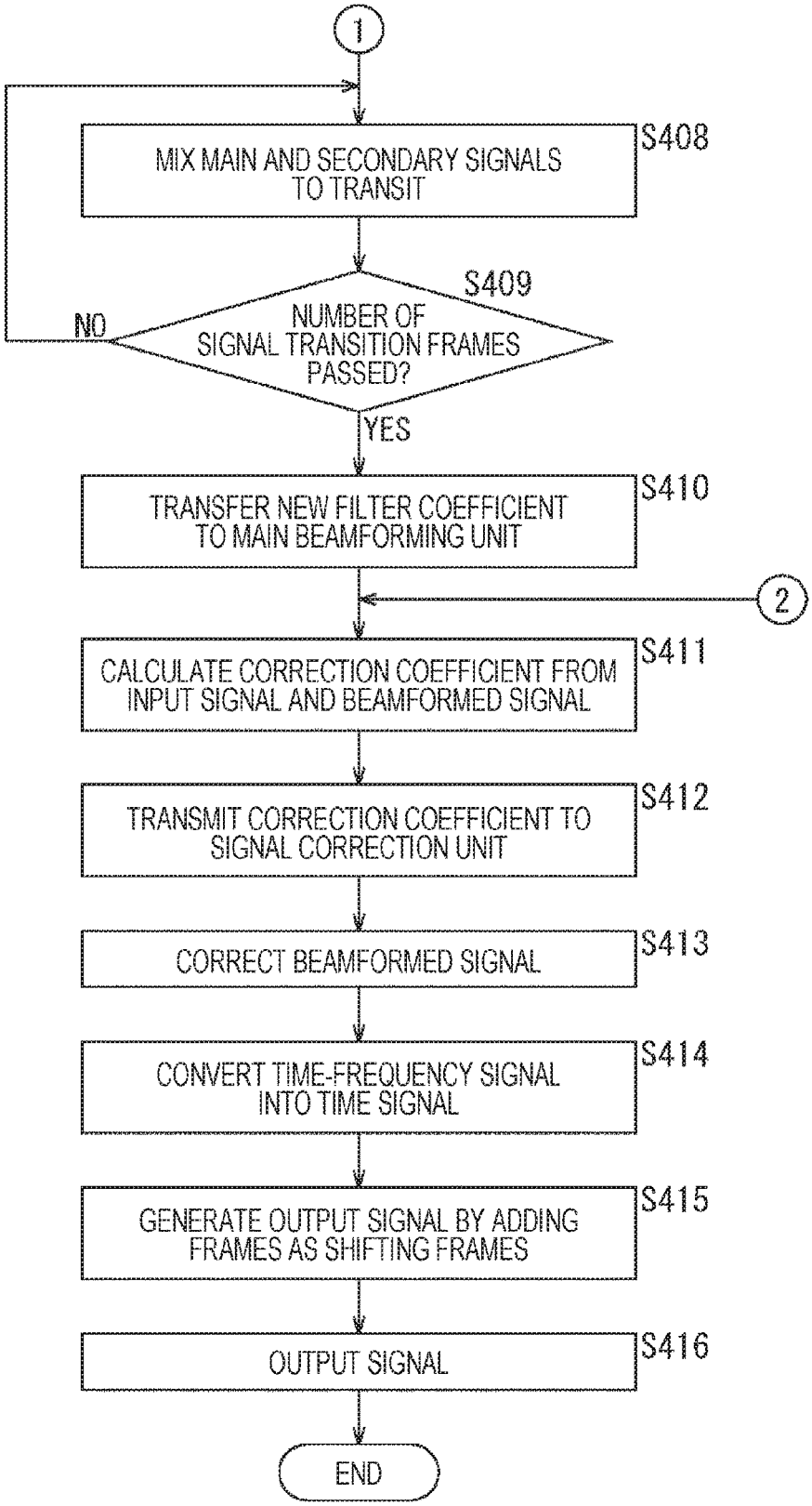
FIG. 27 is a flowchart for explaining the operation by second-2 sound processing device.

An operation of the sound processing device 400 having such a configuration will be explained with reference to the flowcharts of FIGS. 26 and 27. Since the basic operation is similar to that of the sound processing device 300 illustrated in FIG. 3, the explanation of the similar operation will be omitted.

Figure 23:
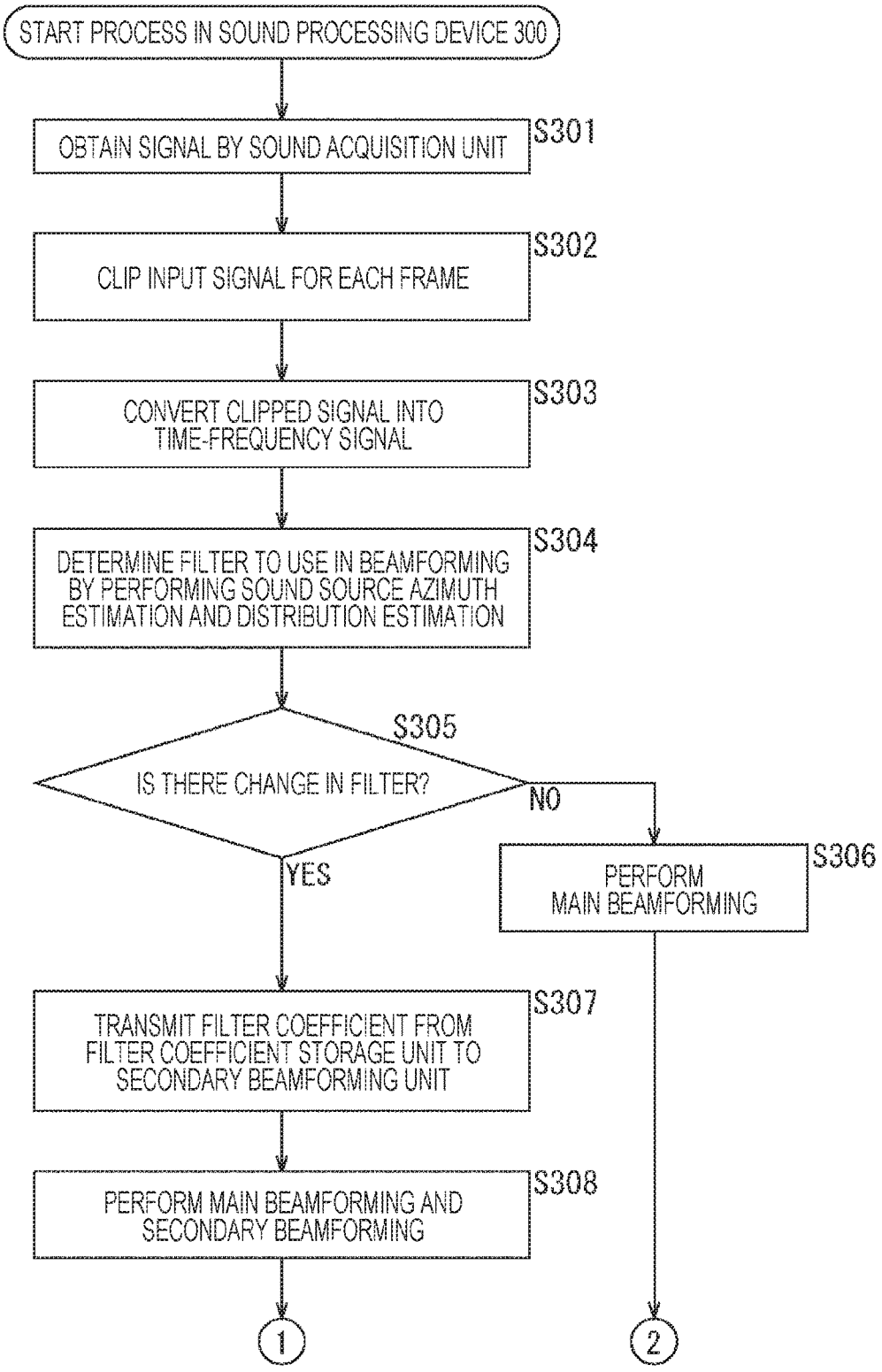
FIG. 23 is a flowchart for explaining an operation by the second-1 sound processing device.

Each process of steps S401 to S403 (FIG. 26) is performed similarly to each process in step S301 to 303 illustrated in FIG. 23.

In other words, the second-1 sound processing device 300 preforms a process of determining a filter in step S304; however, such a process is not needed in the second-2 sound processing device 400 and the process is omitted in the flowchart. Then, in the second-2 sound processing device 400, in step S404, it is determined whether or not there is an instruction to change the filter.

When it is determined in step S404 that there is not an instruction to change the filter, the process proceeds to step S405 and, when it is determined that there is an instruction to change the filter, the process proceeds to step S406.

Since each process insteps S405 to S416 (FIG. 27) is performed basically similarly to each process in step S306 to S317 in FIGS. 23 and 24, the explanation thereof will be omitted.

In this manner, in the second-2 sound processing device 400, information used to select a filter is input from outside (by the user). Similarly to the first-1 sound processing device 100, first-2 sound processing device 200, and second-1 sound processing device 300, also in the second-2 sound processing device 400, a proper filter can be selected and an occurrence of a sudden noise or the like can be properly handled so that the accuracy of the sound processing such as a sound recognition rate can be improved.

Further, similarly to the second-1 sound processing device 300, also in the second-2 sound processing device 400, the user does not have to have an uncomfortable feeling in the output signals even if the filter coefficient is changed.

<About Recording Medium>

The series of the above described processes may be executed by hardware or may be executed by software. When the series of the processes is executed by software, a program composing the software is installed to a computer. Here, the computer may be a computer mounted in dedicated hardware, a general personal computer which executes various functions by installing various programs, or the like.

Figure 28:
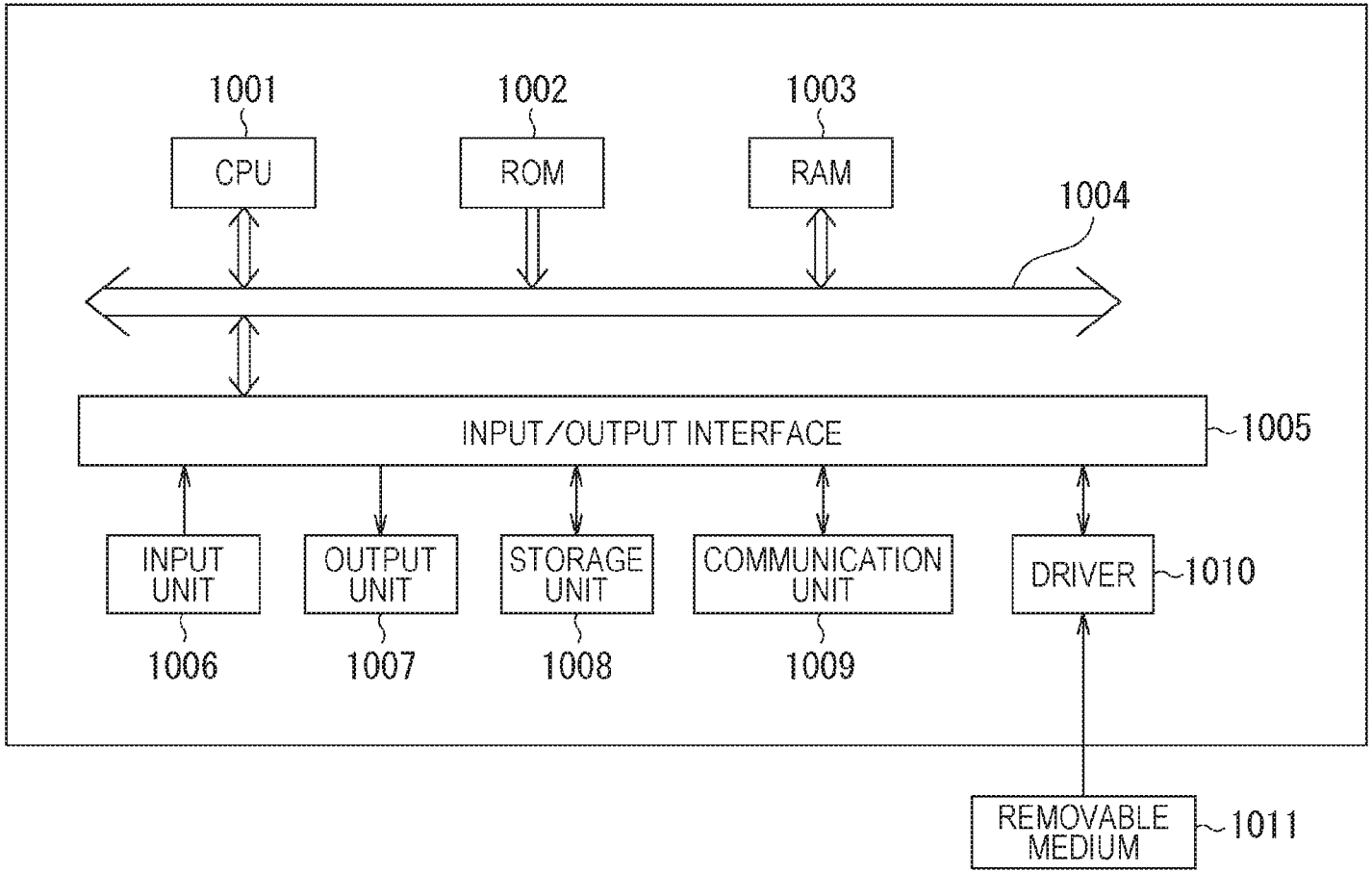
FIG. 28 is a diagram for explaining a recording medium.

FIG. 28 is a block diagram illustrating a configuration example of hardware of a computer that executes the above described series of processes by programs. In the computer, a central processing unit (CPU) 1001, a read only memory (ROM) 1002, and a random access memory (RAM) 1003 are connected to one another via a bus 1004. To the bus 1004, an input/output interface 1005 is further connected. To the input/output interface 1005, an input unit 1006, an output unit 1007, a storage unit 1008, a communication unit 1009, and a driver 1010 are connected.

The input unit 1006 is composed of a keyboard, a mouse, a microphone, or the like. The output unit 1007 is composed of a display, a speaker, or the like. The storage unit 1008 is composed of a hard disk, a non-volatile memory, or the like. The communication unit 1009 is composed of a network interface, or the like. The driver 1010 drives a removable medium 1011 such as a magnetic disk, an optical disk, a magnetic optical disk, a semiconductor memory, or the like.

In the computer having an above described configuration, for example, the above described series of processes is performed by the CPU 1001 by loading a program stored in the storage unit 1008 to the RAM 1003 via the input/output interface 1005 and bus 1004 and executing the program.

The program executed by the computer (CPU 1001) can be recorded in the removable medium 1011 as a packaged medium or the like and provided for example. Further, the program can be provided via a wired or wireless transmission medium such as a local area network, the Internet, or digital satellite broadcasting.

In the computer, the program can be installed to the storage unit 1008 via the input/output interface 1005 by attaching the removable medium 1011 to the driver 1010. Further, the program can be received by the communication unit 1009 via a wired or wireless transmission medium and installed to the storage unit 1008. In addition, the program may be installed to the ROM 1002 or storage unit 1008 in advance.

Here, the program executed by the computer may be a program that the processes are executed in chronological order according to the order described in this specification or may be a program that the processes are executed in parallel or at necessary timings according to a call.

Further, in this specification, the system represents an entire device composed of a plurality of devices.

Here, the effects described in this specification are examples and do not set any limitation, and there may be another effect.

Here, embodiments according to the present technology are not limited by the above described embodiments and various modifications can be made within a scope of the present technology.

Here, the present technology may have the following configurations.

(1)

A sound processing device including:

a sound collection unit configured to collect a sound;

an application unit configured to apply a predetermined filter to a signal of the sound collected by the sound collection unit;

a selection unit configured to select a filter coefficient of the filter applied by the application unit; and a correction unit configured to correct the signal from the application unit.

(2)

The sound processing device according to (1), wherein the selection unit selects the filter coefficient on the basis of the signal of the sound collected by the sound collection unit.

(3)

The sound processing device according to (1) or (2), wherein the selection unit creates, on the basis of the signal of the sound collected by the sound collection unit, a histogram which associates a direction where the sound occurs and a strength of the sound and selects the filter coefficient on the basis of the histogram.

(4)

The sound processing device according to (3), wherein the selection unit creates the histogram on the basis of signals accumulated for a predetermined period of time.

(5)

The sound processing device according to (3), wherein the selection unit selects a filter coefficient of a filter that suppresses the sound in an area other than an area including a largest value in the histogram.

(6)

The sound processing device according to any of (1) to (5), further including a conversion unit configured to convert the signal of the sound collected by the sound collection unit into a signal of a frequency range, wherein the selection unit selects the filter coefficient for all frequency bands by using the signal from the conversion unit.

(7)

The sound processing device according to any of (1) to (5), further including a conversion unit configured to convert the signal of the sound collected by the sound collection unit into a signal of a frequency range, wherein the selection unit selects the filter coefficient for each frequency band by using the signal from the conversion unit.

(8)

The sound processing device according to any of (1) to (7), wherein the application unit includes a first application unit and a second application unit, the sound processing device further includes a mixing unit configured to mix signals from the first application unit and the second application unit, when a first filter coefficient is switched to a second filter coefficient, a filter with the first filter coefficient is applied in the first application unit and a filter with the second filter coefficient is applied in the second application unit, and the mixing unit mixes the signal from the first application unit and a signal from the second application unit with a predetermined mixing ratio.

(9)

The sound processing device according to (8), wherein, after a predetermined period of time has passed, the first application unit starts a process in which the filter with the second filter coefficient is applied and the second application unit stops processing.

(10)

The sound processing device according to (1), wherein the selection unit selects the filter coefficient on the basis of an instruction from a user.

(11)

The sound processing device according to any of (1) to (10), wherein the correction unit performs a correction to further suppress a signal which has been suppressed in the application unit when the signal of the sound collected by the sound collection unit is smaller than the signal to which a predetermined filter is applied by the application unit, and performs a correction to suppress a signal which has been amplified by the application unit when the signal of the sound collected by the sound collection unit is larger than the signal to which a predetermined filter is applied by the application unit.

(12)

The sound processing device according to any of (1) to (11), wherein the application unit suppresses a constant noise, and the correction unit suppresses a sudden noise.

(13)

A sound processing method including:

collecting a sound;

applying a predetermined filter to a signal of the collected sound;

selecting a filter coefficient of the applied filter; and correcting the signal to which the predetermined filter is applied.

(14)

A program that causes a computer to execute a process including the steps of:

collecting a sound;

applying a predetermined filter to a signal of the collected sound;

selecting a filter coefficient of the applied filter; and correcting the signal to which the predetermined filter is applied.

REFERENCE SIGNS LIST

100 Sound processing device
101 Sound collection unit
102 Time-frequency conversion unit
103 Beamfeming unit
104 Filter selection unit
105 Filter coefficient storage unit
106 Signal correction unit
108 Time-frequency reverse conversion unit
200 Sound processing device
201 Filter instruction unit
300 Sound processing device
301 Beamfeming unit
302 Main beamforming unit
303 Secondary beamforming unit
304 Signal transition unit
400 Sound processing device
401 Filter instruction unit

The invention claimed is:

1. A sound processing device, comprising:

a sound collection unit configured to collect a sound;

a conversion unit configured to convert a signal of the sound collected by the sound collection unit into a signal of a frequency range;

an application unit configured to apply a filter to the signal of the sound collected by the sound collection unit;

a selection unit configured to select a filter coefficient of the filter applied by the application unit, wherein the filter co-efficient for a frequency band is selected based on the signal of the frequency range; and a correction unit configured to correct a signal from the application unit.

2. The sound processing device according to claim 1, wherein the selection unit is further configured to select the filter coefficient based on the signal of the sound collected by the sound collection unit.

3. The sound processing device according to claim 1, wherein the selection unit is further configured to:

create, based on the signal of the sound collected by the sound collection unit, a histogram which associates a direction where the sound occurs and a strength of the sound; and select the filter coefficient based on the histogram.

4. The sound processing device according to claim 3, wherein the selection unit is further configured to create the histogram based on signals accumulated for a period of time.

5. The sound processing device according to claim 3, wherein the selection unit is further configured to select the filter coefficient of the filter that suppresses the sound in an area other than an area including a largest value in the histogram.

6. The sound processing device according to claim 1, wherein:

the application unit includes a first application unit and a second application unit, the sound processing device further comprises a mixing unit configured to mix a signal from the first application unit and a signal from the second application unit, the first application unit is configured to apply a filter with a first filter coefficient and the second application unit is configured to apply a filter with a second filter coefficient, based on a switch from the first filter coefficient to the second filter coefficient, and the mixing unit is further configured to mix the signal from the first application unit and the signal from the second application unit with a mixing ratio.

7. The sound processing device according to claim 6, wherein, after a period of time has passed, the first application unit is configured to start application of the filter with the second filter coefficient to the signal of the sound collected by the sound collection unit and the second application unit is configured to stop.

8. The sound processing device according to claim 1, wherein the selection unit is configured to select the filter coefficient based on a user instruction.

9. The sound processing device according to claim 1, wherein the correction unit is further configured to:

suppress a signal which has been suppressed in the application unit when the signal of the sound collected by the sound collection unit is smaller than the signal from the application unit, and suppress a signal which has been amplified by the application unit when the signal of the sound collected by the sound collection unit is larger than the signal from the application unit.

10. The sound processing device according to claim 1, wherein:

the application unit is further configured to suppress a constant noise, and the correction unit is further configured to suppress a sudden noise.

11. A sound processing method, comprising:

collecting a sound;

converting a signal of the collected sound into a signal of a frequency range;

applying a filter to the signal of the collected sound;

selecting a filter coefficient of the applied filter, wherein the filter co-efficient for a frequency band is selected based on the signal of the frequency range; and correcting a signal to which the filter is applied.

12. A non-transitory computer-readable medium having stored thereon computer-executable instructions that, when executed by a processor, cause a computer to execute operations, the operations comprising:

collecting a sound;

converting a signal of the collected sound into a signal of a frequency range;

applying a filter to the signal of the collected sound;

selecting a filter coefficient of the applied filter, wherein the filter co-efficient for a frequency band is selected based on the signal of the frequency range; and correcting a signal to which the filter is applied.

13. A sound processing device, comprising:

a sound collection unit configured to collect a sound;

an application unit configured to apply a filter to a signal of the sound collected by the sound collection unit;

a selection unit configured to:

create a histogram based on the signal of the sound collected by the sound collection unit; and select a filter coefficient of the filter based on the histogram, wherein the histogram associates a direction where the sound occurs and a strength of the sound; and a correction unit configured to correct a signal from the application unit.

* * * * *